US007982694B2

(12) United States Patent
Ogura et al.

(10) Patent No.: US 7,982,694 B2
(45) Date of Patent: Jul. 19, 2011

(54) DISPLAY APPARATUS AND DRIVE CONTROL METHOD

(75) Inventors: Jun Ogura, Fussa (JP); Tsuyoshi Ozaki, Fuchu (JP)

(73) Assignee: Casio Computer Co., Ltd., Tokyo (JP)

( * ) Notice: Subject to any disclaimer, the term of this patent is extended or adjusted under 35 U.S.C. 154(b) by 876 days.

(21) Appl. No.: 11/717,385

(22) Filed: Mar. 13, 2007

(65) Prior Publication Data

US 2007/0216613 A1 Sep. 20, 2007

(30) Foreign Application Priority Data

Mar. 14, 2006 (JP) ..... 2006-068992

(51) Int. Cl.
*G09G 3/30* (2006.01)

(52) U.S. Cl. ..... 345/76

(58) Field of Classification Search ..... 345/30, 345/55, 76

See application file for complete search history.

(56) References Cited

U.S. PATENT DOCUMENTS

| | | | | |
|---|---|---|---|---|
| 6,489,952 | B1 * | 12/2002 | Tanaka et al. | 345/205 |
| 2004/0149886 | A1 | 8/2004 | Matsueda et al. | |
| 2004/0189627 | A1 * | 9/2004 | Shirasaki et al. | 345/204 |
| 2006/0028408 | A1 | 2/2006 | Kim | |
| 2006/0114193 | A1 * | 6/2006 | Kwak et al. | 345/76 |
| 2006/0139260 | A1 * | 6/2006 | Shibusawa | 345/76 |
| 2008/0143648 | A1 * | 6/2008 | Ishizuka et al. | 345/76 |
| 2009/0289931 | A1 | 11/2009 | Matsueda et al. | |

FOREIGN PATENT DOCUMENTS

| | | | |
|---|---|---|---|
| CN | 1716370 | A | 1/2006 |
| JP | 2001-42822 | A | 2/2001 |
| JP | 2004-133411 | A | 4/2004 |

OTHER PUBLICATIONS

Chinese Office Action (and English translation thereof) dated Oct. 31, 2008, issued in a counterpart Chinese Application.

Japanese Office Action dated Jun. 25, 2010 and English translation thereof, issued in counterpart Japanese Application No. 2006-068992.

* cited by examiner

*Primary Examiner* — Richard Hjerpe
*Assistant Examiner* — Jeffrey Parker
(74) *Attorney, Agent, or Firm* — Holtz, Holtz, Goodman & Chick, P.C.

(57) ABSTRACT

A display apparatus includes a display panel having a plurality of display pixels two-dimensionally arrayed display pixels having pixel drive circuits and light emitting devices near at intersections of a plurality of scan lines and a plurality of data lines laid out in a row direction and in a column direction so as to be orthogonal to each other, a scan driver which applies a scan signal to the scan lines at a predetermined timing, a data driver which supplies a gradation signal corresponding to display data to the display pixels via the data lines, and a pair of power source drivers which apply a supply voltage to both ends of a plurality of power supply lines laid out in the column direction at a predetermined timing.

16 Claims, 20 Drawing Sheets

DISPLAY APPARATUS AND DRIVE CONTROL METHOD

BACKGROUND OF THE INVENTION

1. Field of the Invention

The present invention relates to a display apparatus and a drive control method therefore. Particularly, the invention relates to a display apparatus equipped with a display panel (display pixel array) having an array of a plurality of display pixels with a current-controlled (or current-driven) light emitting devices which emit lights of predetermined luminance gradations when supplied with a current according to display data, and a drive control method for the display apparatus.

2. Description of the Related Art

Recently, researches and developments for fully practical use and popularization of a light emission type display as the next generation display device to a liquid crystal display (LCD) which is widely used as a monitor or a display for a personal computer, a video device, portable information device and so forth have become active. The light emission type display has a display panel with a two-dimensional array of organic electroluminescence devices (organic EL devices), or self-emitting devices (self-emission type optical elements), such as light emitting diodes (LEDs).

Particularly, the light emission type display employing an active matrix drive system has a faster display response than an LCD. In addition, the light emission type display does not have a view angle dependency, and can achieve high luminescence, high contrast, high definition of display quality, etc. Further, the light emission type display has an excellent feature such that, unlike the LCD, it does not need a backlight, thus ensuring a flatter and lighter configuration.

Various drive control mechanisms and control methods for controlling the operation (emission state) of light emitting devices in such a light emission type display. For example, Unexamined Japanese Patent Application KOKAI Publication No. 2001-42822 describes the configuration having a drive circuit (pixel drive circuit) including a plurality of switching devices for emission drive control of a light emitting device for each of arrayed display cells of the display panel.

The display pixel having the conventional pixel drive circuit will be briefly described below.

FIG. 19 is a diagram showing the essential portion of the schematic configuration of a conventional active matrix type light emission display (organic EL display). FIG. 20 is a diagram showing the circuit configuration of a display cell to be used in the conventional active matrix type light emission display (organic EL display).

The light emission type display (organic EL display) described in the Unexamined Japanese Patent Application KOKAI Publication No. 2001-42822 has, as shown in FIG. 19, a display panel 110P, a scan-line drive circuit (scan driver) 120P, and a data-line drive circuit (data driver) 130P. The display panel 110P has a matrix of display cells (display pixels) EMp respectively provided at intersections of a plurality of scan lines Yp and a plurality of data lines Xp arrayed in rows and columns. The scan-line drive circuit 120P applies a scan-line select voltage to the individual scan lines Yp at a given timing. The data-line drive circuit 130P applies a data voltage to the individual data lines Xp at a given timing.

Each display cell EMp has a pixel drive circuit DCp having a select transistor (TFT) T1*p*, a drive transistor (TFT) T2*p*, and a capacitor Cp, as shown in FIG. 20, for example. The select transistor T1*p* has a gate terminal connected to the associated scan line Yp, a drain terminal connected to the associated data line Xp, and a source terminal connected to a node Np. The drive transistor T2*p* has a gate terminal connected to the node Np, and a source terminal connected to a common line Gp to which a ground potential GND is supplied. The capacitor Cp is connected between the node Np and the source terminal of the drive transistor T2*p*. An organic EL device OEL which is a current-controlled light emitting device has a cathode terminal connected to the drain terminal of the drive transistor T2*p* of the pixel drive circuit DCp, and an anode terminal connected to a supply voltage line Vp to which a supply voltage Vdd higher than the ground potential GND is supplied.

In the light emission type display with the display panel 110P having the display cells EMp, first, the scan-line drive circuit 120P sequentially applies the ON-level scan-line select voltage to the individual scan lines Yp to turn on the select transistors T1*p* of the display cells EMp (pixel drive circuits DCp) in a row, thereby setting the display cells EMp selected. In synchronism with the timing, the data-line drive circuit 130P applies the data voltage to the individual data lines Xp in columns so that a potential corresponding to the data voltage is applied to the node Np (i.e., the node between the gate terminal of the drive transistor T2*p* and one end of the capacitor Cp) via the select transistor T1*p* of each display cell EMp (pixel drive circuit DCp).

Accordingly, the drive transistor T2*p* is turned on in a conductive state corresponding to the potential of the node Np (strictly, the potential difference between the gate and source) (i.e., conductive state corresponding to the data voltage). A predetermined emission drive current flows to the common line Gp (ground potential GND) via the organic EL device OEL and the drive transistor T2*p* from the supply voltage line Vp (supply voltage Vdd), causing the organic EL device OEL to emit light with a luminance gradation corresponding to the data voltage (display data). At this time, the potential (data voltage) applied to the gate terminal (node Np) of the drive transistor T2*p* is held (stored) in the capacitor Cp.

Next, the scan-line drive circuit 120P applies the OFF-level scan-line select voltage to the scan lines Yp to turn off the select transistors T1*p* of the display cells EMp in a row. This sets the display cells EMp unselected, electrically disconnecting the data lines Xp from the pixel drive circuits DCp. At this time, the potential (data voltage) held in the capacitor Cp causes the potential of the gate terminal (node Np) of the drive transistor T2*p* to be held. As a result, a predetermined voltage is applied between the gate and source of the drive transistor T2*p*, so that the drive transistor T2*p* keeps the ON state. Accordingly, as in the light emission operation in the selected state, a predetermined emission drive current flows to the common line Gp (ground potential GND) via the organic EL device OEL and the drive transistor T2*p* from the supply voltage line Vp (supply voltage Vdd), so that light emission is maintained.

This drive control method controls the value of the emission drive current flowing to the organic EL device OEL to ensure light emission with a predetermined luminance gradation by regulating the value of the data voltage to be applied to each display cell EMp (specifically, the gate terminal of the drive transistor T2*p* of the pixel drive circuit DCp).

As the drive control method for an active matrix type light emission display, current-based gradation control is known in addition to the voltage-based gradation control described in the Unexamined Japanese Patent Application KOKAI Publication No. 2001-42822. The current-based gradation control supplies the data current having a value corresponding to display data to the display cells set in a selected state, thereby controlling the value of the emission drive current flowing to each organic EL device OEL according to the value of the data current.

In consideration of enlarging the display panel of the display apparatus, which has the aforementioned display cells (pixel drive circuits), however, the following problem arises in case of a display panel having a wide screen whose horizontal-vertical screen ratio (aspect ratio) is, for example, 16:9 and compatible with high vision video images of 1920 horizontal pixels×1080 vertical pixels.

In the display panel 110P shown in FIG. 19 and FIG. 20, the supply voltage Vdd to permit the emission drive current to flow to the of each organic EL device OEL of each display cell EMp is applied via the supply voltage line Vp commonly connected to the entire display cells. In consideration of the large aspect ratio (wide screen) or the high definition design of the display panel, the scan lines Yp laid out in rows and the supply voltage line Vp become considerably long in the widthwise direction of the display panel (the left and right direction in FIG. 19), and the number of display cells to be connected to the scan lines Yp and the supply voltage line Vp becomes considerably large. The longer the distance from the scan-line drive circuit 120P or the supply section (contact) for the supply voltage Vdd is (near the center area of the display panel 110P shown in FIG. 19), the greater the voltage drop originated by the wire resistance becomes, changing the values of the scan-line select voltage and the supply voltage Vdd to be applied to each display cell (voltage drops) and causing a signal delay.

With regard to the supply voltage line Vp to which the supply voltage Vdd is supplied, particularly, when the value of the supply voltage Vdd to be supplied to each display cell in the display panel changes, it does not become possible to permit flow of the emission drive current whose value corresponds to the display data (data voltage) to each display cell. This disables light emission with a desired luminance gradation, degrading the display quality. This problem also arises in a case of controlling the value of the emission drive current flowing to the organic EL device OEL using the value of the data current corresponding to display data.

SUMMARY OF THE INVENTION

Accordingly, it is an object of the present invention to provide a display apparatus which allows an emission drive current having an adequate current value corresponding to display data to flow to light emitting devices to ensure light emission with an adequate luminance gradation and an excellent display quality even in a case of enlarging a display panel or designing a high-definition display panel, and a drive control method for the display apparatus.

A display apparatus having a display panel according to the first aspect of the invention includes:

a substrate whose distance between both peripheral edge portions in a column direction is shorter than a distance between both peripheral edge portions in a row direction;

a plurality of display pixels provided on the substrate in the row direction and the column direction;

a plurality of power source lines laid out on the substrate in the row direction and connected to the plurality of display pixels; and a plurality of power supply lines laid out to the peripheral edge portion of the substrate in the column direction and connected to the power source lines at individual nodes.

The display apparatus according to the invention and the drive control method therefore allow an emission drive current having an adequate current value corresponding to display data to flow to light emitting devices to ensure light emission with an adequate luminance gradation. This can achieve an excellent display quality even in a case of enlarging a display panel or designing a high-definition display panel.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A display apparatus and a drive control method therefore both according to the present invention will be described below by way of embodiment with reference to the accompanying drawings. The following description of the embodiment will be given of a light emission display apparatus which is configured to have a two-dimensional array of a plurality of display pixels (display cells) each having a light emitting device and displays image information as the individual display pixels perform light emission with a luminance gradation corresponding to display data (video image data). However, the invention is not limited to this particular type, but may be adapted to a display apparatus which, like an LCD, performs gradation control on each display pixel according to display data (sets the gradation sate corresponding to display data), and displays desired image information with transmission light to the display panel or reflected light therefrom.

<Display Apparatus>

First, the schematic configuration of the display apparatus according to the invention will be described referring to the accompanying drawings.

Figure 1:
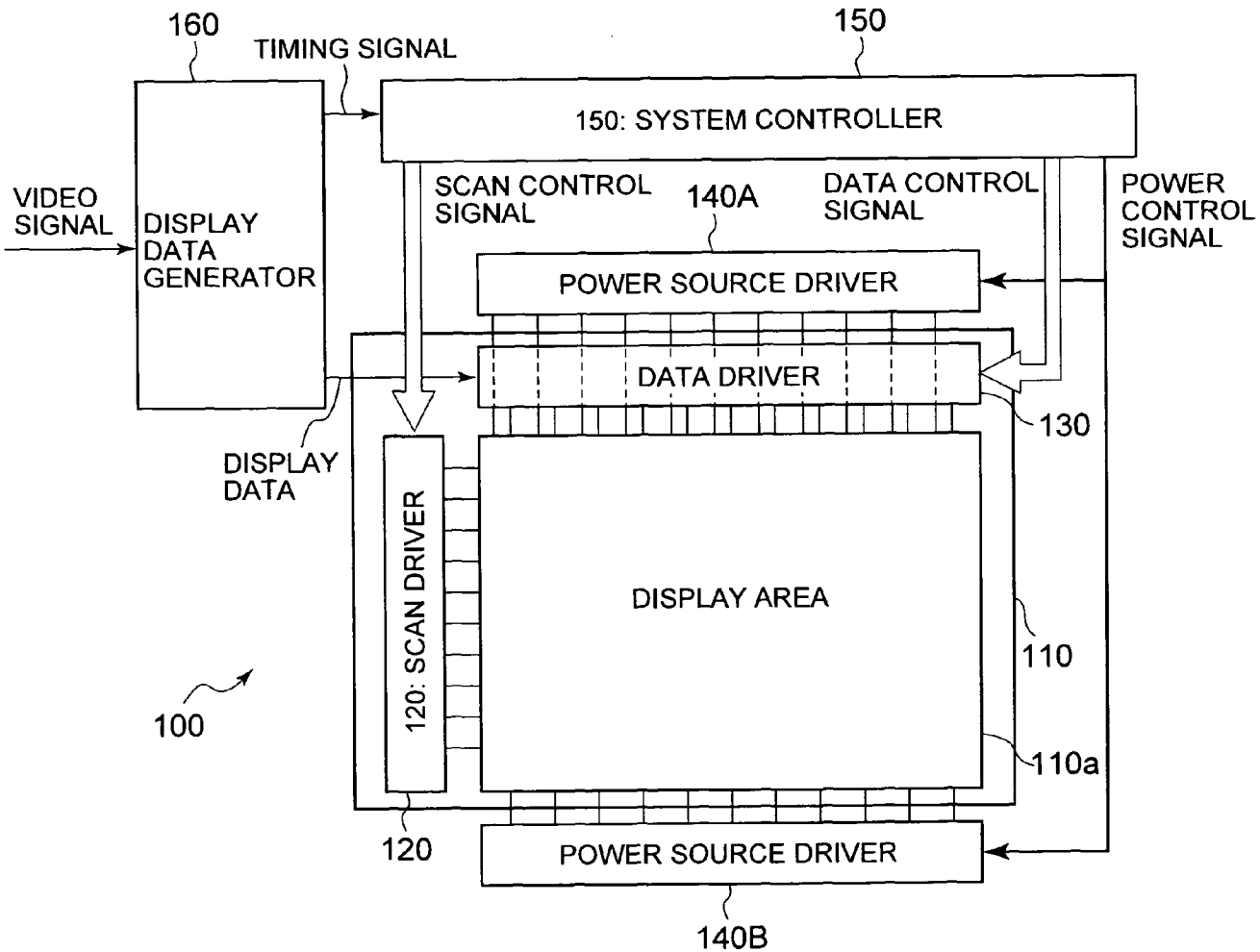
FIG. 1 is a schematic block diagram showing a display apparatus according to one embodiment of the present invention.
Figure 2:
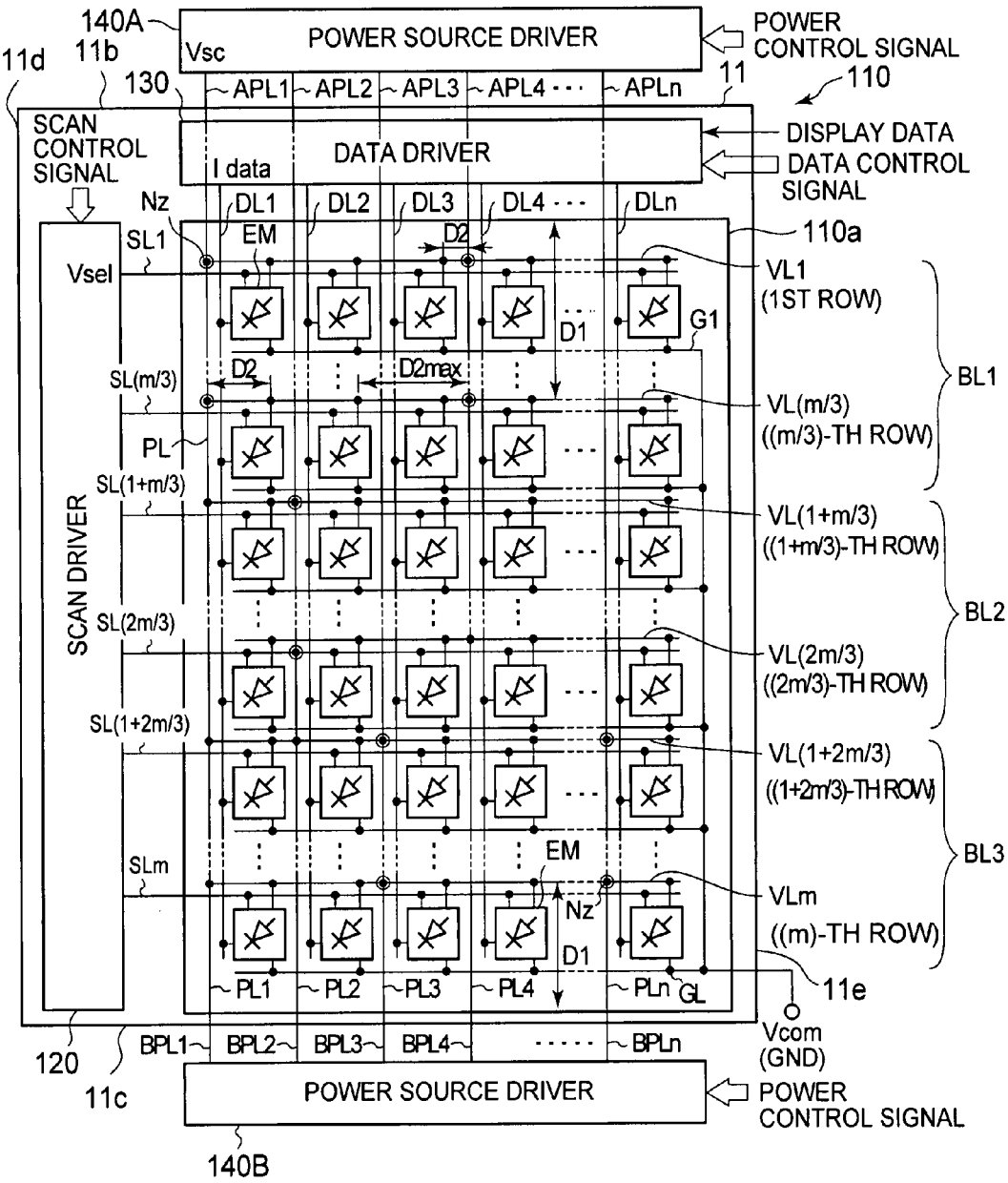
FIG. 2 is a schematic configuration diagram showing one example of a display panel to be used in the display apparatus according to the embodiment.

FIG. 1 is a schematic block diagram showing the display apparatus according to one embodiment of the invention. FIG. 2 is a schematic configuration diagram showing one example of a display panel to be used in the display apparatus according to the embodiment.

As shown in FIGS. 1 and 2, the display apparatus, 100, according to the embodiment includes a display panel 110, a scan driver (scan drive unit) 120, a data driver (data drive unit) 130, a pair of power source drivers (power drive units) 140A and 140B, a system controller (drive control unit) 150, and a display data generator 160. The display panel 110 schematically has a display area 110*a* where a plurality of display pixels EM each having a pixel drive circuit and a light emitting device to be described later are arrayed two-dimensionally near the individual intersections of m scan lines SL (SL1, SL2, . . . , SLm) and n data lines DL (DL1, DL2, . . . , DLn) provided on an insulative substrate 11 and laid out in a row direction (horizontal direction in the diagrams) and a column direction (vertical direction in the diagrams) in such a way as to intersect each other (where m and n are multiples of 3). The scan driver 120, connected to the scan lines SL of the display panel 110, applies a scan signal Vse1 of a select level (ON-level signal which is a high level if an n-channel transistor is to be selected and is a low level if a p-channel transistor is to be selected) to the scan lines SL at a given timing to sequentially set individual rows of display pixels EM in a selected state. The data driver 130, connected to the data lines DL of the display panel 110, controls the current value of a gradation signal (gradation current Idata) according to display data, which flows to each row of display pixels EM set in the selected state by the scan driver 120. The pair of power source drivers 140A, 140B are respectively connected to one end and the other end of n power supply lines PL (PL1, PL2, . . . , PLn) laid out in the column direction, and apply supply voltages (first supply voltage and second supply voltage) Vsc to the power supply lines PL at a given timing. Based on a timing signal supplied from the display data generator 160 to be described later, the system controller 150 at least generate a scan control signal, a data control signal and a power control signal to control the operational states of the scan driver 120, the data driver 130, and the power source drivers 140A, 140B for executing a predetermined image display operation of the display panel 110, and sends the control signals to the scan driver 120, the data driver 130 and the power source drivers 140A, 140B respectively. The display data generator 160 generates display data (luminance gradation data) based on a video image signal supplied from outside the display apparatus 100, and supplies the display data to the data driver 130. Based on the display data, the display data generator 160 extracts or generates a timing signal (system clock or the like) for displaying predetermined image information on the display panel 110, and sends the timing signal to the system controller 150.

The individual structures will be described below specifically.

Figure 3:
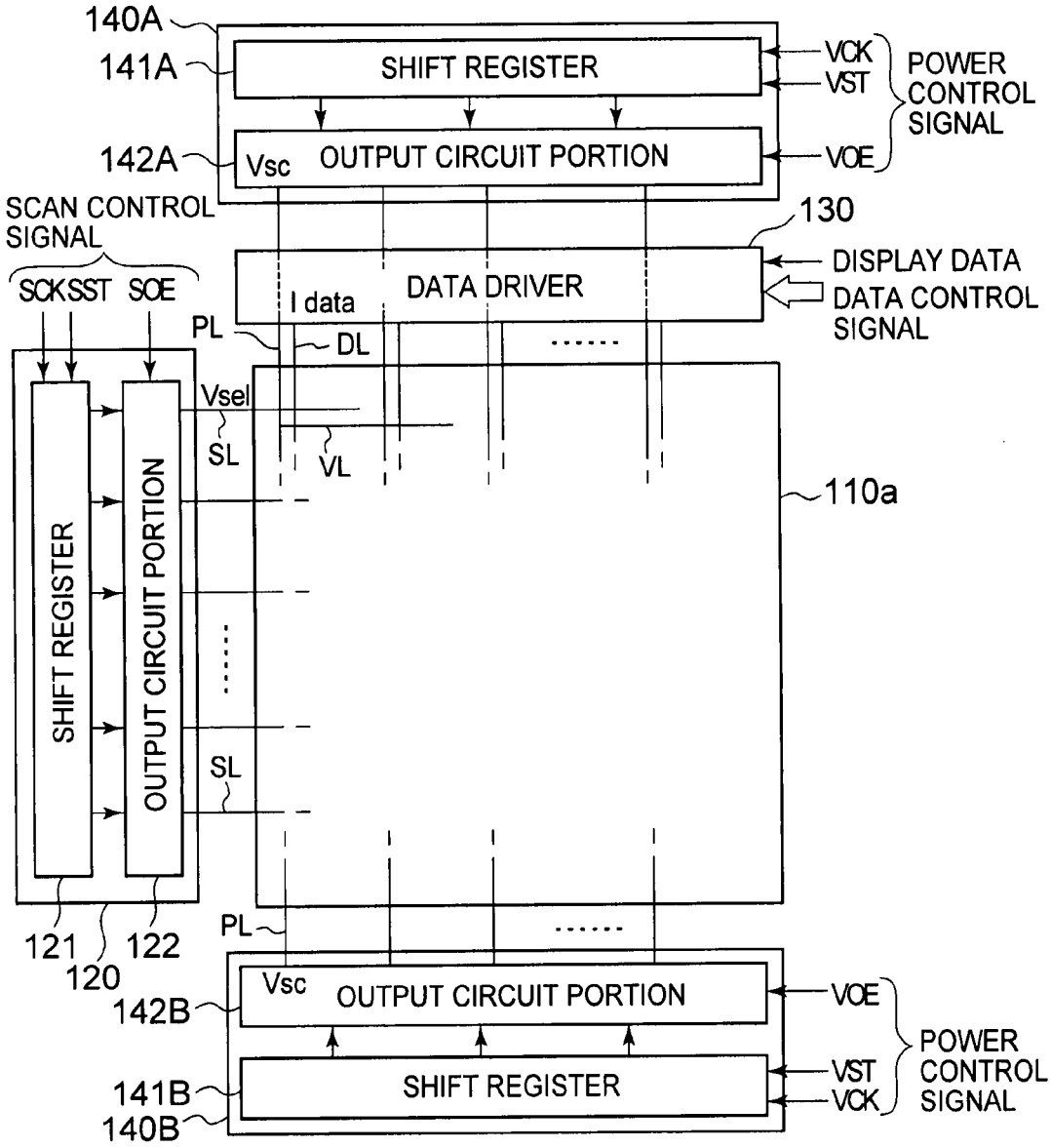
FIG. 3 is a schematic configuration diagram showing one example of peripheral circuits (scan driver, power source driver) of the display panel to be used in the display apparatus according to the embodiment.
Figure 4:
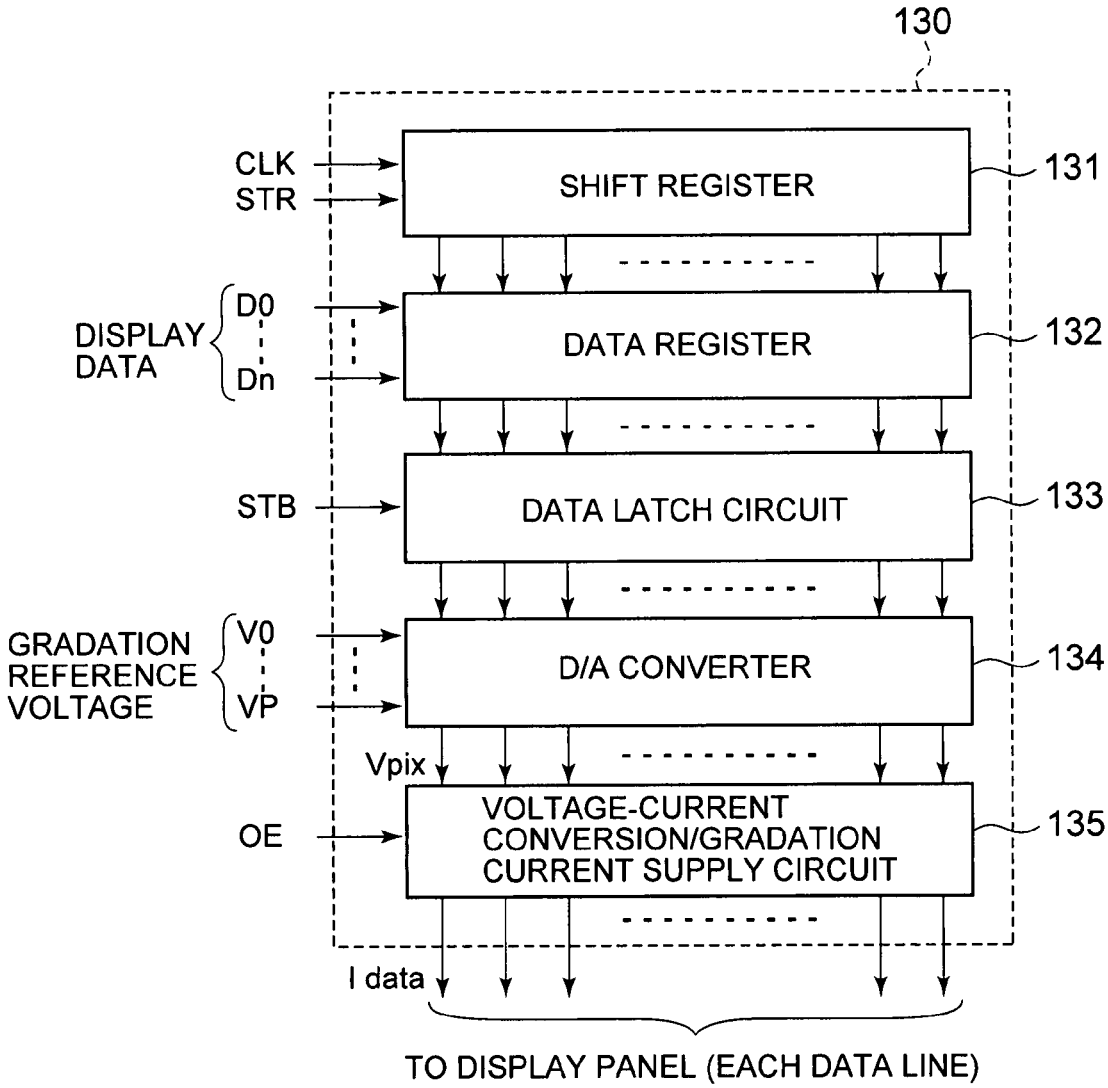
FIG. 4 is a schematic configuration diagram showing one example of a data driver to be used in the display apparatus according to the embodiment.

FIG. 3 is a schematic configuration diagram showing one example of peripheral circuits (scan driver, power source driver) of the display panel to be used in the display apparatus according to the embodiment. FIG. 4 is a schematic configuration diagram showing one example of the data driver to be used in the display apparatus according to the embodiment.

(Display Panel)

As shown in FIG. 2, the display panel 110 which is adopted to the display apparatus 100 according to the embodiment has a plurality of display pixels EM two-dimensionally arrayed in rows and columns in the display area 110*a* located in the center of one surface of the transparent insulative substrate 11, and separated into an arbitrary member of pixel blocks (three pixel blocks BL1 to BL3 in FIG. 2) each including plural rows of display pixels EM. Further, the power source lines VL (VL1, VL2, . . . , VLm) are laid out in the row direction, i.e., in parallel to the scan lines SL.

The display area 110*a* of the display panel 110 has the aspect ratio set like 3:4 or 9:16 so that the column-directional length is shorter than the row-directional length. The distance between both columnar-directional peripheral edge portions 11*b* and 11*c* of the insulative substrate 11 is set shorter the distance between both row-directional peripheral edge portions 11*d* and 11*e*.

The power supply lines PL extend across the display area 110*a* in the column direction to near the both columnar-directional peripheral edge portions 11*b* and 11*c* of the substrate 11.

In the vicinity of the upper peripheral edge portion 11*b*, one ends of the power supply lines PL are connected to one ends of the lead wires APL (APL1, APL2, APL3, . . . , APLn). The other ends of the lead wires APL are connected to the power source driver 140A. Likewise, in the vicinity of the lower peripheral edge portion 11*c*, the other ends of the power supply lines PL are connected to one ends of the lead wires BPL (BPL1, BPL2, BPL3, . . . , BPLn). The other ends of the lead wires BPL are connected to the power source driver 140B.

The lead wires APL and the lead wires BPL are formed on a flexible printed board, and the power source driver 140A and the power source driver 140B may be, or may not be, formed on the flexible printed board.

A plurality of nodes Nz grouped for each of the pixel blocks BL1 to BL3 are provided on each power supply line PL. Each node Nz is connected to the power source line VL extending in an approximately orthogonal direction to the power supply line PL. Each power supply line PL is connected to a group of the power source lines VL grouped into one of the pixel blocks BL1 to BL3. In other words, each power source line VL is grouped into one of the pixel blocks BL1 to BL3. Each power source line VL is connected to the individual power supply lines PL in one grouped pixel block BL, which are laid out in the column direction at predetermined distances, provided in the row direction, excluding every certain number of power supply lines PL equal to the number of pixel blocks at the associated node Nz. That is, each power source line VL is connected to the power supply lines PL, with the (number of pixel blocks−1) power supply lines PL in between being excluded, at the associated nodes Nz.

More specifically, the individual display pixels EM in the pixel block BL1 are connected to a plurality of nodes Nz of the power supply lines PL1, PL4, . . . , PL(3xr+1) where r is an integer equal to or greater than 0 such that 3xr+3 becomes equal to or less than the total number n of the power supply lines PL. Likewise, the individual display pixels EM in the pixel block BL2 are connected to a plurality of nodes Nz of the power supply lines PL2, PL5, . . . , PL(3xr+2). Further, the individual display pixels EM in the pixel block BL3 are connected to a plurality of nodes Nz of the power supply lines PL3, PL6, . . . , PL(3xr+3).

In the display panel 110 shown in FIG. 2, apparently, the first to m/3-th power source lines VL1 to VL(m/3) included in the pixel block BL1 are connected to both the power source drivers 140A, 140B via the power supply lines PL1, PL4, . . . , PL(3xr+1) connected at the nodes Nz, and the lead wires APL and BPL. The (1+m/3)-th to (2xm/3)-th power source lines VL(1+m/3) to VL(2xm/3) included in the pixel block BL2 are connected to the power source drivers 140A, 140B via the power supply lines PL2, PL5, . . . , PL(3xr+2) connected at the nodes Nz. The (1+2xm/3)-th to m-th power source lines VL(1+2xm/3) to VLm included in the pixel block BL3 are connected to the power source drivers 140A, 140B via the power supply lines PL3, PL6, . . . , PL(3xr+3) connected at the nodes Nz. The total number of the power supply lines PL is set equal to the total number of the data lines DL in the display panel 110 shown in FIG. 2. However, the total number of the power supply lines PL may be set less than the total number of the data lines DL. For example, in a case where each display pixel EM includes three color components (color pixels) of red (R), green (G) and blue (B) to be described later, the total number of the power supply lines PL may be set to n/3.

Let D1max be the longest distance in shorter ones of distances D1 from the individual nodes Nz of a plurality of power supply lines PL to one ends of the power supply lines PL which are connected to the power source driver 140A and the other ends of the power supply lines PL which are connected to the power source driver 140B. For the first row of display pixels EM, for example, a distance Du from each node Nz of the power supply line PL to one end thereof is shorter than a distance Dd from each node Nz of the power supply line PL to the other end thereof.

For the individual nodes Nz, shorter distances are compared with one another, and the longest distance thereamong, e.g., the distance from the node Nz in the m/2-th row or the (1+m/2)-th row to one end of the power supply line PL or the other end thereof, is set as the distance D1max.

Let D2max be the longest distance (about half the interval between adjoining nodes Nz in the row direction in FIG. 2) in distances D2 from the individual display pixels EM (three display pixels EM in FIG. 2) between two nodes adjoining in the row direction to the closest node Nz. The sum of the distance D1max and the distance D2max is set shorter than half the distance between both peripheral edge portions 11*d*, 11*e* in the row direction of the substrate 11.

For each display pixel EM, a shorter one of the distance to one end of the power supply line PL connected to the power source driver 140A and the distance to the other end of the power supply line PL connected to the power source driver 140B is set shorter than half the distance between both peripheral edge portions 11*d*, 11*e* in the row direction of the substrate 11. It is therefore possible to make shorter the distance of the longest one of the interconnection wires from the display pixels EM to the peripheral edge portions of the substrate 11 as compared with a case where the individual power supply lines PL are laid out to extend in the row direction so that one ends and other ends thereof are respectively disposed in the vicinity of both peripheral edge portions 11*d*, 11*e*. The voltage drop of such an interconnection wire becomes greater as the distance of the interconnection wire becomes longer. It is therefore possible to suppress a voltage drop at that portion which is affected most by the voltage drop.

As described above, the lead terminals of the power supply lines PL for connection to the power source driver 140A or the power source driver 140B are provided at that peripheral side of the display panel 110 (substrate 11) which is the shorter side of the aspect ratio (column direction). This makes it possible to suppress a voltage drop at that one of the interconnection portions from the lead terminals of the power supply lines PL to the display pixels EM which has the longest distance, as compared with a case where the lead terminals of the power supply lines PL for connection to the power source driver 140A or the power source driver 140B are provided at that peripheral side of the display panel 110 (substrate 11) which is the longer side of the aspect ratio (row direction). This can reduce a variation in the display characteristic of each display pixel EM.

Although lead wires (lead wires APL or lead wires BPL) are provided on both columnar-directional peripheral edge portions of the display panel 110 in the above-described example, lead wires may be provided only one peripheral edge portion. In this case, if the lead wires APL are provided only at the upper peripheral edge portion 11*b* of the power supply lines PL, the power supply lines PL are connected only to the power source driver 140A via the lead wires APL. That is, the power source driver 140B need not be provided. If the lead wires BPL are provided only at the lower peripheral edge portion 11*c* of the power supply lines PL, however, the power supply lines PL are connected only to the power source driver 140B via the lead wires BPL. That is, the power source driver 140A need not be provided. When the lead wires are provided only one peripheral edge portion (e.g., peripheral edge portion 11*b*) in the column direction (modification), a comparative example to the modification would be a display panel configured in such a way that the power supply lines PL are laid out to extend in the row direction and the lead wires are provided only one (e.g., peripheral edge portion 11*d*) of both columnar-directional peripheral edge portions 11*d*, 11*e*. The distance from the node Nz farthest from one peripheral edge portion (e.g., peripheral edge portion 11*b*), i.e., the node Nz closest to the other peripheral edge portion (e.g., peripheral edge portion 11*c*) opposite to the one peripheral edge portion in the column direction, to the one peripheral edge portion (e.g., peripheral edge portion 11*b*) in the modification can be made shorter than the distance from the node Nz farthest from one peripheral edge portion (e.g., peripheral edge portion 11*d*), i.e., the node Nz closest to the other peripheral edge portion (e.g., peripheral edge portion 11*e*) opposite to the one peripheral edge portion, to the one peripheral edge portion (e.g., peripheral edge portion 11*d*). A specific example of the display pixels will be described in detail later.

(Scan Driver)

The scan driver 120 is provided in the display panel 110, specifically, on the insulative substrate 11 of the display panel 110. The scan driver 120 sets each row of display pixels EM in a selected state by applying the scan signal Vse1 of the select level (ON-level signal for the display pixels EM to be described later) to individual scan lines SL in rows based on the scan control signal supplied from the system controller 150. Specifically, the scan driver 120 sets individual rows of display pixels EM in a selected state in order by executing the operation of applying the scan signal Vse1 to the scan lines SL at non-overlapping timings shifted from one another.

In the display apparatus 100 according to the embodiment, particularly, plural rows of display pixels EM grouped into a pixel block beforehand in the display panel 110 are set in a selected state in order by sequentially applying the scan signal Vse1 applied to the scan lines SL in the group. Further, all the display pixels EM arrayed in the display panel 110 are sequentially set in a selected state row by row by repeatedly executing a similar operation for the individual pixel blocks.

As shown in FIG. 3, for example, the scan driver 120 includes a well-known shift register 121, and an output circuit portion (output buffer) 122. The shift register 121 sequentially outputs a shift signal corresponding to each scan line SL based on a scan clock signal SCK and a scan start signal SST supplied as scan control signals from the system controller 150 to be described later. The output circuit portion 122 converts the level of the shift signal output from the shift register 121 to a predetermined signal level (select level), and sends the converted shift signal as the scan signal Vse1 to the individual scan lines SL based on an output control signal SOE to be supplied as a scan control signal from the system controller 150.

(Data Driver)

The data driver 130 is provided in the display panel 110, specifically, on the insulative substrate 11 of the display panel 110. Based on a data control signal supplied from the system controller 150, the data driver 130 sequentially latches and holds display data (luminance gradation data) including a digital signal, supplied from the display data generator 160 to be described later, row by row at a predetermined timing. Then, the data driver 130 generates a gradation current Idata having a current value corresponding to the gradation value of the display data. The data driver 130 supplies the gradation current Idata to the display pixels EM of the row set in the selected state (write period) via the data lines DL in columns at a time.

As shown in FIG. 4, for example, the data driver 130 includes a shift register 131, a data register 132, a data latch circuit 133, a D/A converter 134, and a voltage-current conversion/gradation current supply circuit 135. The shift register 131 sequentially outputs a shift signal based on a data control signal (shift clock signal CLK, sampling start signal STR) supplied from the system controller 150. The data register 132 sequentially latches one row of display data D0-Dn supplied from the display data generator 160 at the input timing of the shift signal. The data latch circuit 133 holds the one row of display data D0-Dn registered in the data register 132 based on a data control signal (data latch signal STB). The D/A converter 134 converts the latched display data D0-Dn to a predetermined analog signal voltage (gradation voltage Vpix) based on gradation reference voltages V0 to VP supplied from power supply section (not shown). The voltage-current conversion/gradation current supply circuit 135 generates the gradation current Idata corresponding to the display data converted to the analog signal voltage, and sends the gradation current Idata to those data lines DL which correspond to the display data at the timing based on a data control signal (output enable signal OE) supplied from the system controller 150.

The data driver 130 shown in FIG. 4 is merely an example capable of generating the gradation current Idata having a current value corresponding to display data, and the invention is not limited to this example.

(Power Source Driver)

The power source drivers 140A, 140B supplies a supply voltage Vsc having the same voltage level to lead wires APL and the lead wires BPL at the same time, for each pixel block, based on a power source control signal supplied from the system controller 150. The output supply voltage Vsc is applied to the display pixels EM via the power source lines VL from both ends of the power supply lines PL laid out in the column direction of the display panel 110.

Figure 13:
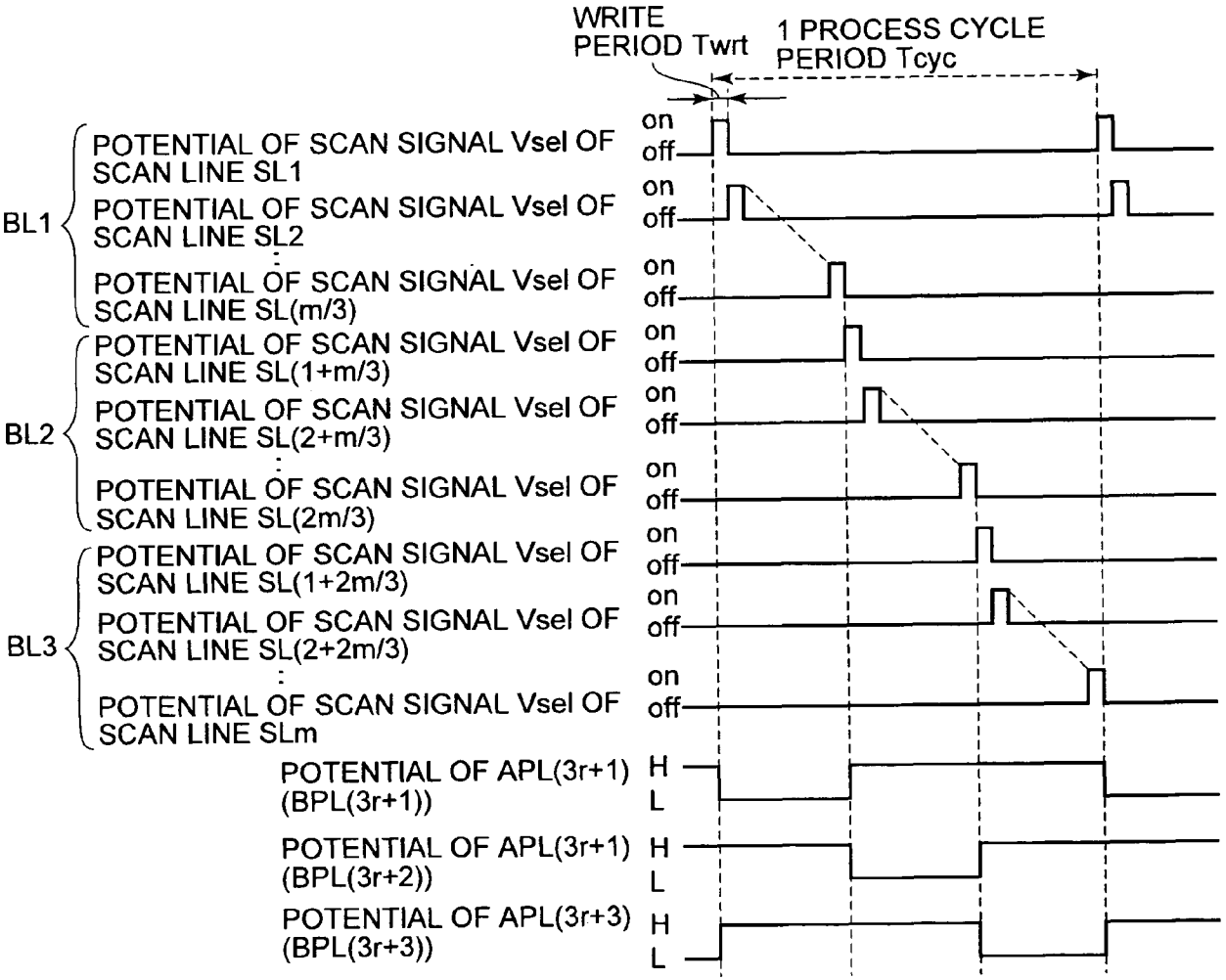
FIG. 13 is a waveform timing chart exemplarily illustrating one example of the drive control method for the display apparatus according to the embodiment.

Specifically, as shown in FIG. 13, in a predetermined pixel block, in the selected state (in a period where each row of display pixels included in that pixel block becomes selected; non-emission period) where the scan signal Vse1 of the select level is sequentially applied to the scan lines SL included in the pixel block by the scan driver 120, the supply voltage Vsc of the low level L (=Vs; first supply voltage) is applied at a time. In this period, the supply voltage Vsc of the high level H (=Ve; second supply voltage) is applied at a time in other pixel blocks than the former pixel block. The supply voltage Vsc is applied to the power source lines VL of the pixel block connected to the power supply lines PL at the nodes Nz (contact holes Hlz).

In the select period for the pixel block BL1, for example, the scan signal Vse1 of the select level (ON level on) is sequentially output to the scan lines SL1, SL2, . . . , SL(m/3). During this period, the power source drivers 140A, 140B synchronously output the supply voltage Vsc of the low level L (=Vs) to the lead wires APL1, APL4, . . . , APL(3xr+1) and lead wires BPL1, BPL4, . . . , BPL(3xr+1). The supply voltage Vsc of the low level L is supplied to the display pixels EM of the pixel block BL1 via the power supply lines PL1, PL4, . . . , PL(3xr+1) and the power source lines VL1, VL2, VL3, . . . , VL(m/3) of the pixel block BL1. During this period, the scan signal Vse1 of the non-select level (OFF level off) is applied to the display pixels EM of the pixel block BL2 and the display pixels EM of the pixel block BL3 to render the display pixels EM in an unselected state, and the supply voltage Vsc of the high level H (=Ve; second supply voltage) is supplied to those display pixels EM.

Likewise, in the select period for the pixel block BL2, for example, the scan signal Vse1 of the select level (ON level on) is sequentially output to the scan lines SL(1+m/3), SL(2+m/3), . . . , SL(2xm/3). During this period, the power source drivers 140A, 140B synchronously output the supply voltage Vsc of the low level L (=Vs) to the lead wires APL2, APL5, . . . , APL(3xr+2) and lead wires BPL2, BPL5, . . . , BPL(3xr+2). The supply voltage Vsc of the low level L is supplied to the display pixels EM of the pixel block BL2 via the power supply lines PL2, PL5, . . . , PL(3xr+2) and the power source lines VL(1+m/3), VL(2+m/3), VL(3+m/3), . . . , VL(2xm/3) of the pixel block BL2. During this period, the scan signal Vse1 of the non-select level (OFF level off) is applied to the display pixels EM of the pixel block BL1 and the display pixels EM of the pixel block BL3 to render the display pixels EM in an unselected state, and the supply voltage Vsc of the high level H is supplied to those display pixels EM.

In the select period for the pixel block BL3, for example, the scan signal Vse1 of the select level (ON level on) is sequentially output to the scan lines SL(1+2xm/3), SL(2+2xm/3), . . . , SLm. During this period, the power source drivers 140A, 140B synchronously output the supply voltage Vsc of the low level L (=Vs) to the lead wires APL3, APL6, . . . , APL(3xr+3) and lead wires BPL3, BPL6, . . . , BPL(3xr+3). The supply voltage Vsc of the low level L is supplied to the display pixels EM of the pixel block BL3 via the power supply lines PL3, PL6, . . . , PL(3xr+3) and the power source lines VL(1+2xm/3), VL(2+2xm/3), VL(3+2xm/3), . . . , VLm of the pixel block BL3. During this period, the scan signal Vse1 of the non-select level (OFF level off) is applied to the display pixels EM of the pixel block BL1 and the display pixels EM of the pixel block BL2 to render the display pixels EM in an unselected state, and the supply voltage Vsc of the high level H is supplied to those display pixels EM.

Accordingly, in case of using the display panel 110 whose screen aspect ratio (horizontal-vertical ratio) corresponds to the wide screen (display panel having the aspect ratio of 16:9, e.g., 1920 horizontal pixels×1080 vertical pixels), the supply path (wire length from the power source driver 140A, 140B to each display pixel EM) of the supply voltage Vsc to be applied to the display pixels EM via the power supply lines PL and the power source lines VL from the power source drivers 140A, 140B becomes shorter than the total length of the power source lines VL laid out in the row direction. This suppresses a voltage drop caused by the wire resistance of the supply path and a delay of the timing of applying the supply voltage. Specific evaluation will be given later.

During the period (write period) where the scan signal of the select level is applied to one row of display pixels EM in the pixel block to render the display pixels EM in a selected state, the display pixels EM of the pixel block are set in a non-emission state (non-display state) as the supply voltage Vsc of the low level L (=Vs) is simultaneously applied to all rows of display pixels EM of the pixel block. After writing to the row of display pixels EM of the pixel block is terminated, the display pixels EM of the pixel block are set in an emission state (display state) as the supply voltage Vsc of the high level H (=Ve) is simultaneously applied to all rows of display pixels EM of the pixel block.

The power source drivers 140A, 140B have the same configuration, and have well-known shift registers 141A, 141B, and output circuit portions 142A, 142B as shown in, for example, FIG. 3. The shift register 141A, 141B sequentially outputs a shift signal corresponding to the number of pixel blocks set in the display panel 110 based on a clock signal VCK and a start signal VST supplied as power source control signals from the system controller 150. The output circuit portion 142A, 142B converts the level of the shift signal to a predetermined voltage level (voltage value Ve, Vs) and sends the converted shift signal as the supply voltage Vsc to the power source lines VL for each pixel block via the power supply lines PL (connected via the nodes Nz) provided in association with each pixel block based on an output control signal VOE supplied as a power source control signal.

In the power source driver 140A, 140B according to the embodiment, the power supply lines PL laid out in the column direction of the display panel 110 are laid out in parallel to the data lines DL, and are connected to each power source line VL in the same pixel block, with every number of power supply lines equal to (the number of pixel blocks set in the display panel 110-1) the associated pixel block being excluded (i.e., every two other power supply lines PL1, PL4, . . . , PL(3xr+1) for the pixel block BL1). Accordingly, as the power source driver 140A, 140B sequentially applies the supply voltage Vsc to the power supply lines PL (every two other power supply lines PL(3xr+1), PL(3xr+2), PL(3xr+3)), the pixel blocks BL1, BL2, BL3 are sequentially set in a non-emission state or an emission state.

Figure 18:
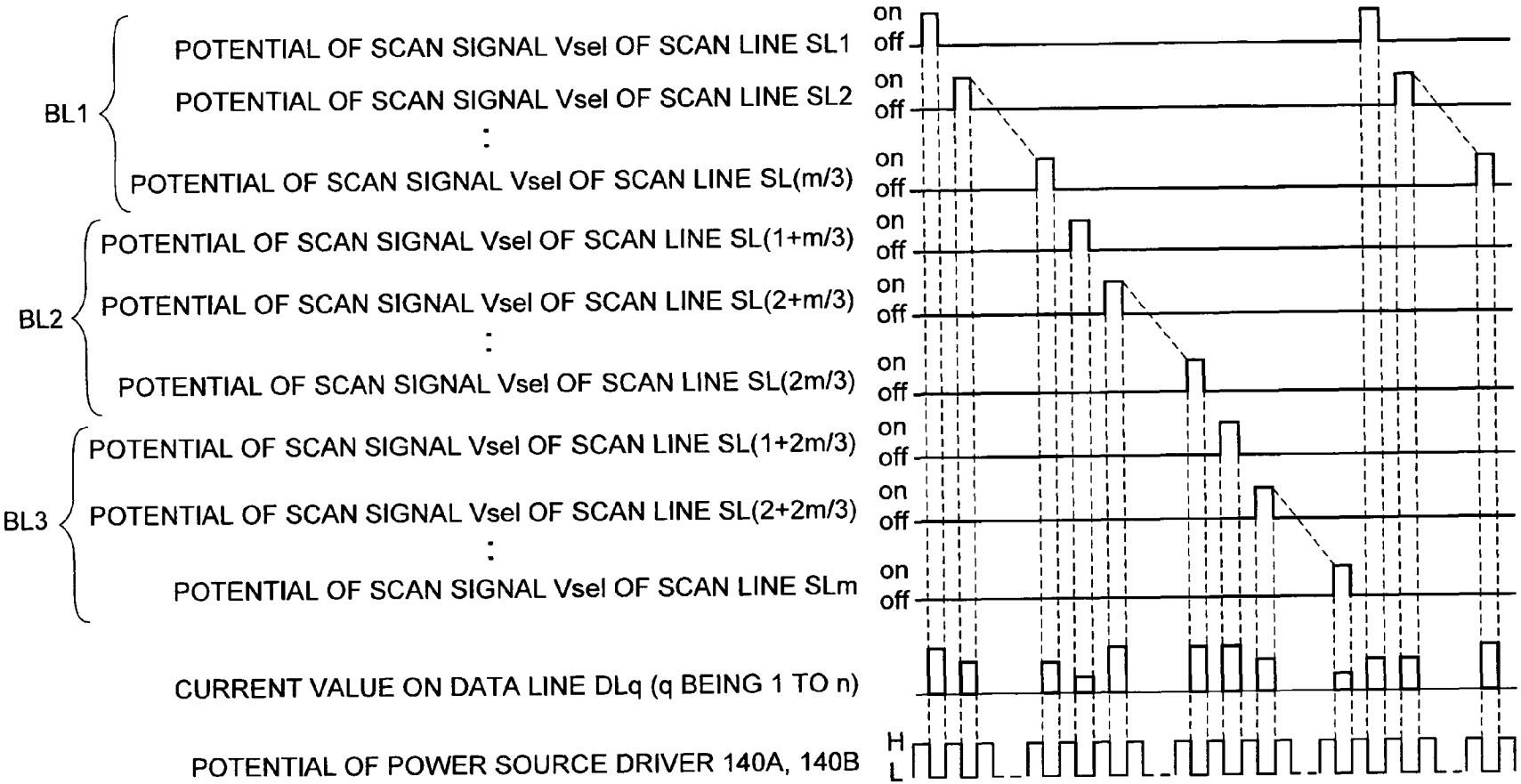
FIG. 18 is a timing chart exemplarily illustrating a still further example of the drive control method for the display apparatus according to the embodiment.
Figure 19:
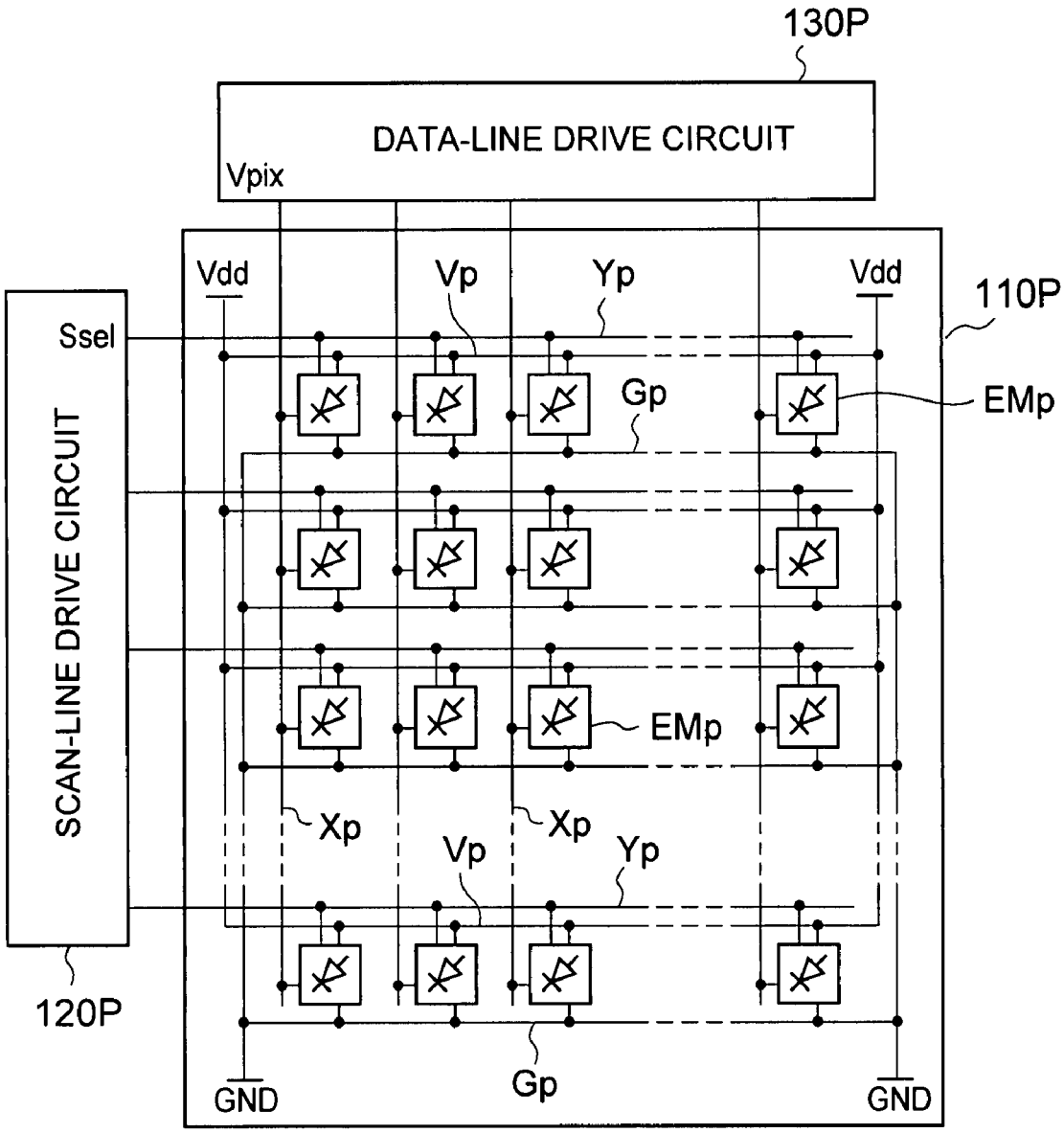
FIG. 19 is a diagram showing the essential portion of the schematic configuration of the conventional active matrix type light emission display (organic EL display)
Figure 20:
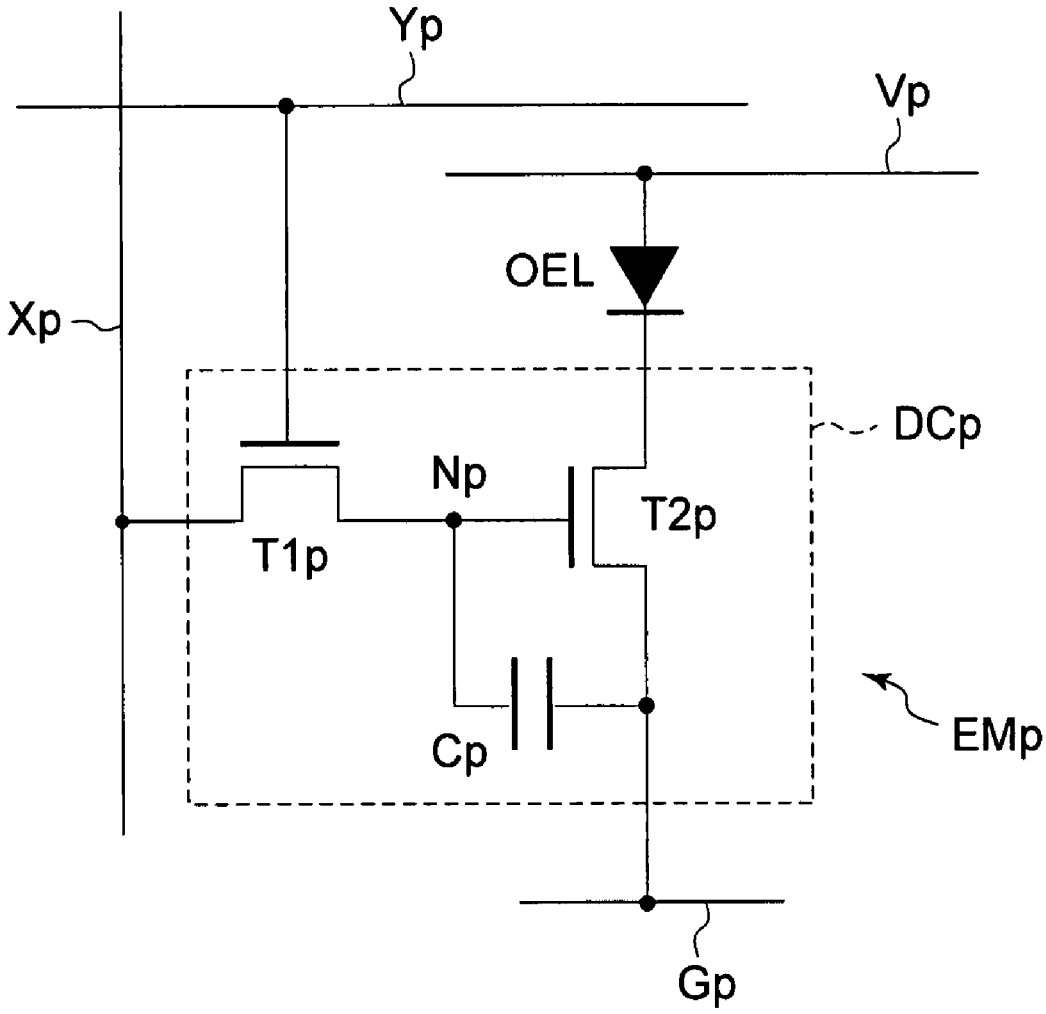
FIG. 20 is a diagram showing the circuit configuration of a display cell to be used in the conventional active matrix type light emission display (organic EL display).

When the select period (write period) of each row and an all-pixel emission period are repeated in order, the power source drivers 140A, 140B may apply the supply voltage Vsc to all the lead wires APL and lead wires BPL at a time based on the power source control signal supplied from the system controller 150 as shown in, for example, FIG. 18. Specifically, the supply voltage Vsc of the low level L (=Vs; first supply voltage) may be applied at a time in the write period, or the supply voltage Vsc of the high level H (=Ve; second supply voltage) may be applied at a time in the emission period.

During the write period, the gradation signal (gradation current Idata) flows to the display pixels EM of the selected row according to display data. At this time, the unselected display pixels EM, like the selected display pixels EM, do not emit light even if the potential between capacitors Cs is high enough for the organic EL device OEL to emit light, because the supply voltage Vsc whose potential is the low level L. When the period is changed to the emission period, of the entire display pixels EM of the display panel 110, those display pixels EM whose potentials between capacitors Cs are high enough for the organic EL device OEL to emit light emit light regardless of whether the row has been selected immediately before or not.

An emission period may be provided between the select period for each row and the select period for a next row this way to enable simultaneous emission of all the pixels that should emit light.

(System Controller)

The system controller 150 at least generates and sends a scan control signal, a data control signal and a power source control signal to the scan driver 120, the data driver 130 and the power source driver 140A, 140B as timing control signals to control the operational states thereof. With the control signals, the system controller 150 operates each driver at a predetermined timing to generate the scan signal Vse1 having a predetermined voltage level, and the gradation signal (gradation current Idata) and the supply voltage Vsc both corresponding to display data and output them to the display panel 110. In this manner, the system controller 150 continuously executes the drive control operation (writing, emission) of the individual display pixels EM (the pixel drive circuit DC to be described later) to perform control to display predetermined image information based on a video signal on the display panel 110 (the display drive control of the display apparatus to be described later).

(Display Data Generator)

The display data generator 160 extracts a luminance gradation signal component from a video signal supplied from, for example, outside the display panel 110, and supplies the luminance gradation signal component to the data register 132 of the data driver 130 as display data (luminance gradation data) comprised of a digital signal for each row of the display panel 110. When the video signal, like a television broadcast signal (composite video signal), includes a timing signal component which defines the display timing for image information, the display data generator 160 may have a function of extracting and supplying the timing signal component in addition to the function of extracting the luminance gradation signal component. In this case, the system controller 150 generates the individual control signals to be individually supplied to the scan driver 120, the data driver 130 and the power source drivers 140A, 140B based on the timing signal supplied from the display data generator 160.

(Specific Example of Display Panel and Display Pixel)

A description will now be given of a specific example of the display panel of the display apparatus according to the embodiment and two-dimensionally arrayed display pixels of the display panel.

Figure 5:
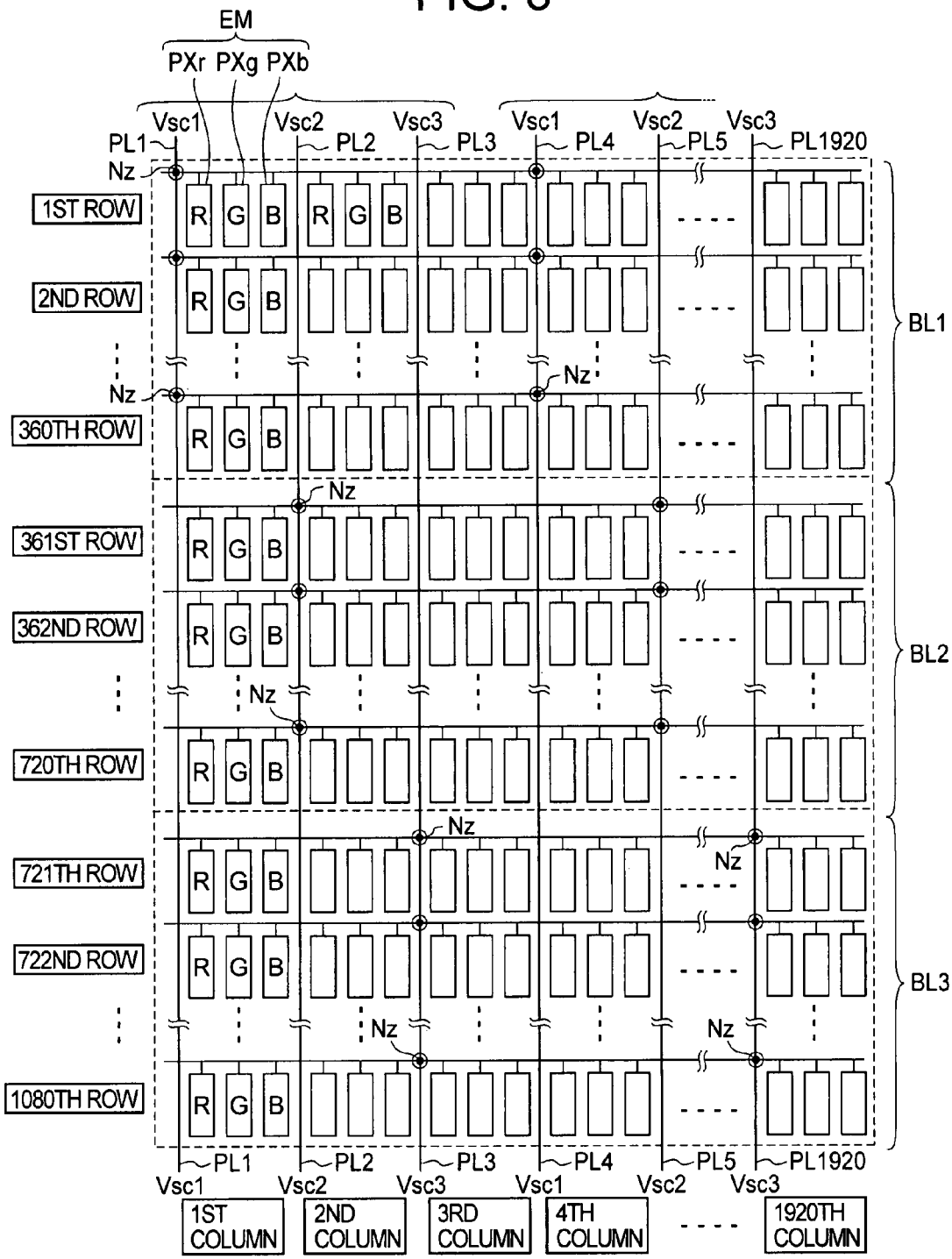
FIG. 5 is a schematic plan view showing one example of the array of pixels of the display panel to be used in the display apparatus according to the embodiment.
Figure 6:
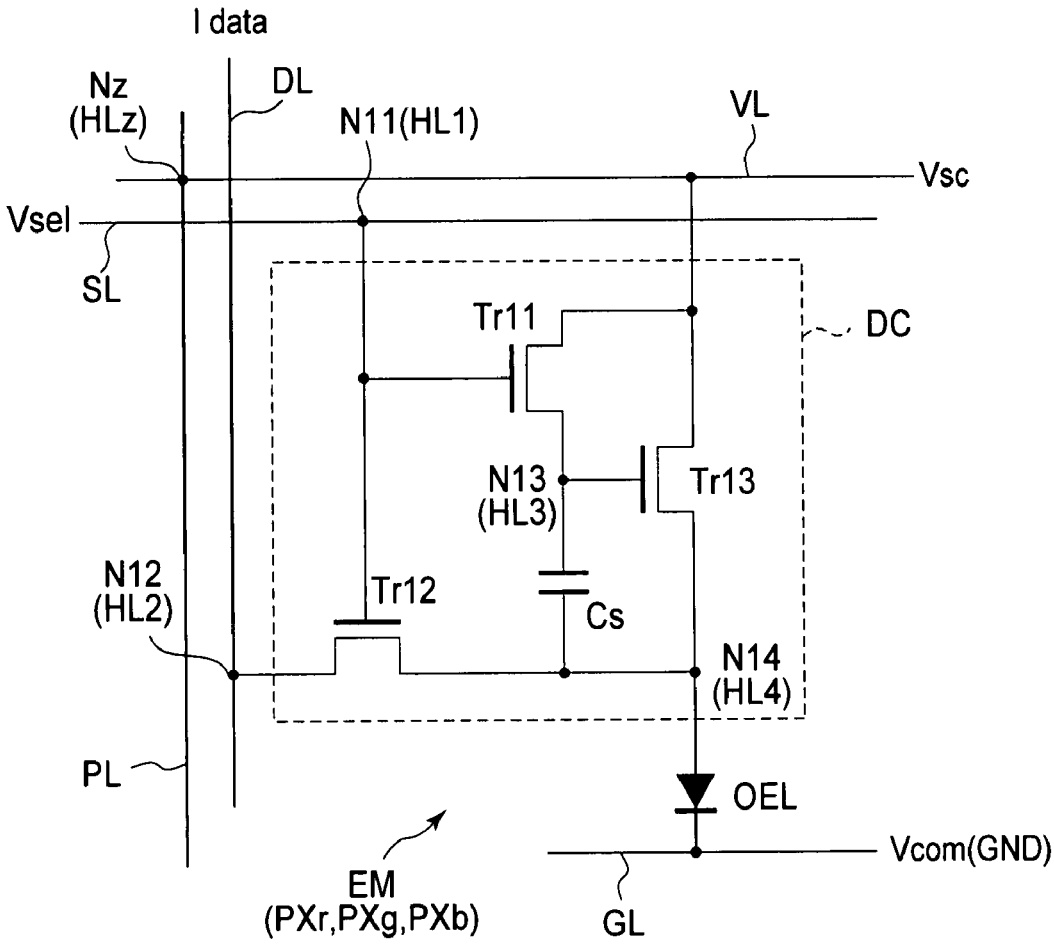
FIG. 6 is an equivalent circuit diagram showing one example of the circuit configuration of display pixels adaptable to the display panel according to the embodiment.

FIG. 5 is a schematic plan view showing one example of the array of pixels of the display panel to be used in the display apparatus according to the embodiment. FIG. 6 is an equivalent circuit diagram showing one example of the circuit configuration of display pixels adaptable to the display panel according to the embodiment. For the sake of descriptive convenience, the plan view of FIG. 5 shows only the relationship between the layout of the display pixels (color pixels) in case of observing the display panel from the view field side and the interconnection structures of the power supply lines and the power source lines, and does not show other lines (scan lines, data lines, etc.) and devices (thin-film transistors, capacitors, etc. which constitute the pixel drive circuit to be described later). Although the description of the specific example will be given of a case where each display pixel EM includes color pixels PXr, PXg, PXb of three colors of red (R), green (G) and blue (B), each display pixel EM may be comprised of a single color pixel (i.e., a monochrome display panel), as shown in FIG. 2.

The display panel adaptable to the embodiment has a plurality of display pixels EM each having a set of color pixels PXr, PXg, PXb of three colors of red (R), green (G) and blue (B), arrayed in a matrix, for example, as shown in FIG. 5. Accordingly, a plurality of (multiple of 3) color pixels PXr, PXg, PXb of three RGB colors are repeatedly laid out in order in the horizontal direction in the diagram, and multiple color pixels PXr, PXg, PXb of the same color are laid out in order in the vertical direction in the diagram. It is assumed in the example that 1920 display pixels EM (the number of color pixels of the RGB colors is 1920×3=5760) are laid out on the insulative substrate in the horizontal direction in the diagram (the lengthwise direction of the display panel 110), and 1080 display pixels EM (the number of color pixels of the RGB colors is 1080) are laid out in the vertical direction in the diagram (the short-side direction of the display panel 110).

Each display pixel EM (RGB color pixels PXr, PXg, PXb) is formed in an area roughly defined by power source lines VL in parallel to the scan lines SL laid out in the row direction and power supply lines PL in parallel to the data lines DL laid out in the column direction.

As in the case illustrated in FIG. 2, the two-dimensionally arrayed display pixels EM of the display panel 110 are grouped in such a way that the first to 360 (=m/3)-th display pixels EM are grouped into the pixel block BL1, the 361 (=1+m/3)-st to 720 (=2xm/3)-th display pixels EM are grouped into the pixel block BL2, and the 721 (=1+2xm/3)-st display to 1080 (=m)-th pixels EM are grouped into the pixel block BL3. The power source lines VL included in each pixel block are connected only to specific number of power supply lines PL for each pixel block.

That is, all the power source lines VL1 to VL360 included in the pixel block BL1 are commonly connected to PL1, PL4, . . . , PL(3xr+1), . . . , PL 1918 via the nodes Nz. All the power source lines VL361 to VL720 included in the pixel block BL2 are commonly connected to PL2, PL5, . . . , PL(3xr+2), . . . , PL1919 via the nodes Nz. All the power source lines VL721 to VL1080 included in the pixel block BL3 are commonly connected to PL3, PL6, . . . , PL(3xr+3), . . . , PL1920 via the nodes Nz.

Each display pixel EM (or the color pixels PXr, PXg, PXb) has the pixel drive circuit DC and the organic EL device (light emitting device) OEL as shown in FIG. 6. The pixel drive circuit DC sets the display pixel EM in a selected state based on the scan signal Vse1 applied via the scan line SL from the scan driver 120. The pixel drive circuit DC acquires the gradation signal (gradation current Idata) supplied via the data line DL from the data driver 130 in the selected state, and generates an emission drive current corresponding to the gradation signal. The organic EL device (light emitting device) OEL emits light of a predetermined luminance gradation based on the emission drive current supplied from the pixel drive circuit DC.

Specifically, the pixel drive circuit DC has a transistor (write control means, second switch means) Tr11, a transistor (write control means, third switch means) Tr12, a transistor (write control means, first switch means) Tr13, and the capacitor (charge storage means, capacitative element) Cs. The transistor Tr11 has a gate terminal connected via a node N11 to the scan line SL, a drain terminal connected to the power source line VL, and a source terminal connected to a node N13. The transistor Tr12 has a gate terminal connected to the scan line SL, a source terminal connected via a node N12 to the data line DL, and a drain terminal connected to a node N14. The transistor Tr13 has a gate terminal connected to a node N13, a drain terminal connected to the power source line VL, and a source terminal connected to the node N14. The capacitor Cs is connected to between the node N13 and the node N14 (between the gate and source of the transistor Tr13). The power source line VL is connected to the power supply line PL to which the supply voltage Vsc is applied via the node Nz. The transistors Tr11 to Tr13 are n-channel thin film transistors.

The organic EL device OEL has an anode terminal (e.g., pixel electrode) connected to the node N14 of the pixel drive circuit DC, and a cathode terminal (e.g., opposing electrode) connected to a common voltage line GL. The common voltage line GL is applied with an arbitrary common voltage Vcom (e.g., ground potential GND) which is equal in potential to Vs, or is higher than Vs and lower in potential than Ve ($Vs \leqq Vcom < Ve$) where Vs is the value of the supply voltage Vsc which is set to the low level L in the write period (select period) during which the gradation signal (gradation current Idata) corresponding to display data is supplied to the display pixel EM and Ve is the value of the supply voltage Vsc which is set to the high level H in the emission period (non-select period) during which the emission drive current is supplied to the organic EL device OEL to emit light of a predetermined luminance gradation.

In FIG. 6, the capacitor Cs may be a parasitic capacitor formed between the gate and source of the transistor Tr13 or an auxiliary capacitor additionally provided between the gate and source. While the transistors Tr11-Tr13 are not particularly restrictive, either an n-channel amorphous silicon transistor or polysilicon transistor may be used, or both may be used.

Although an organic EL device is used as a light emitting device which is cause to emit light by the pixel drive circuit DC in the embodiment, the light emitting device is not limited to this type in the invention, but other light emitting devices, such as a light emitting diode, may be used as long as it is a current-controlled light emitting device. The foregoing description of the embodiment has been given of the case where the pixel drive circuit DC generates the emission drive current corresponding to display data and supplies the emission drive current to the current-controlled light emitting devices to emit light, thereby displaying image information. However, the configuration may be modified to generate a voltage component corresponding to display data for emission drive of voltage-controlled light emitting devices, or the aligned states of the liquid crystal molecules may be changed.

(Drive Control Method for Display Pixels)

The basic drive control method for the above-described display pixels (pixel drive circuit) will be described referring to the accompanying drawings.

Figure 7:
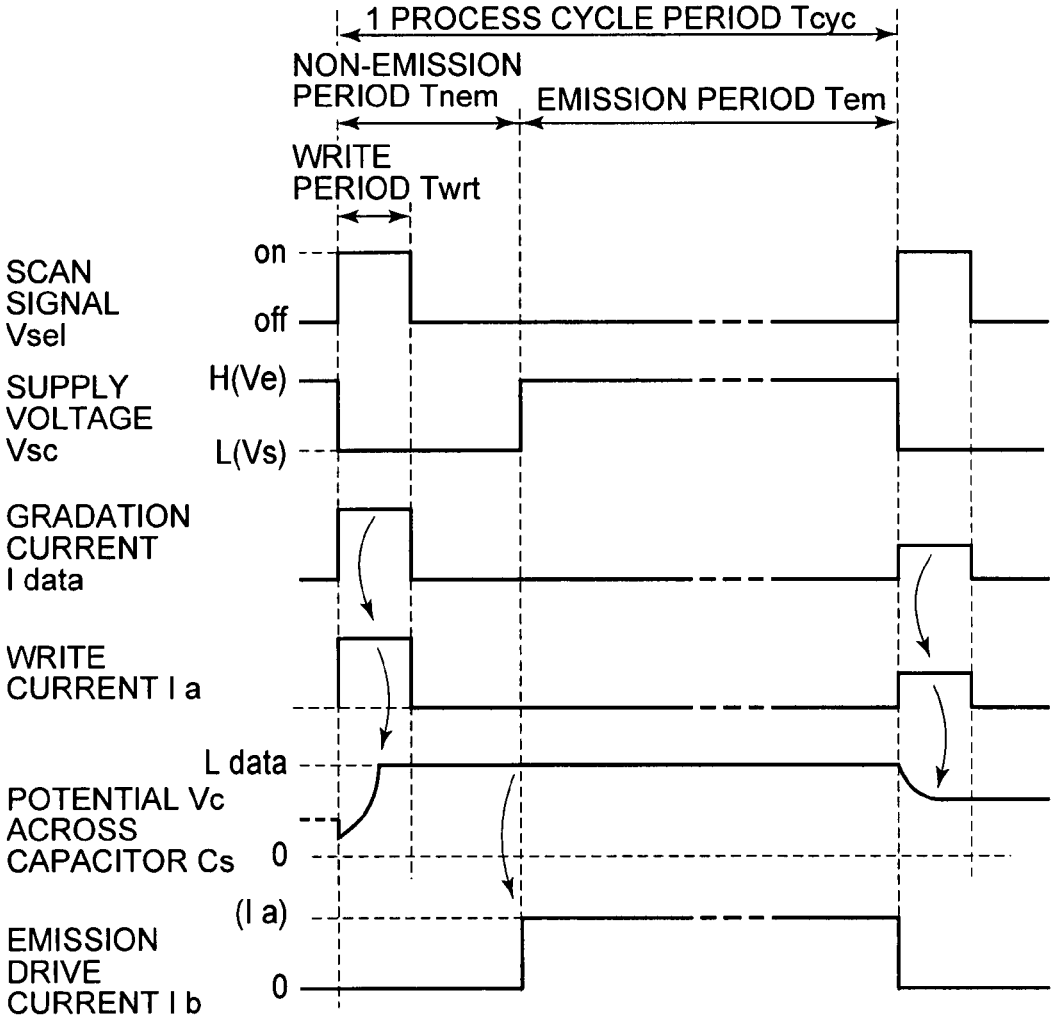
FIG. 7 is a timing chart illustrating a drive control method for display pixels (pixel drive circuits) to be used in the embodiment.
Figure 8A:
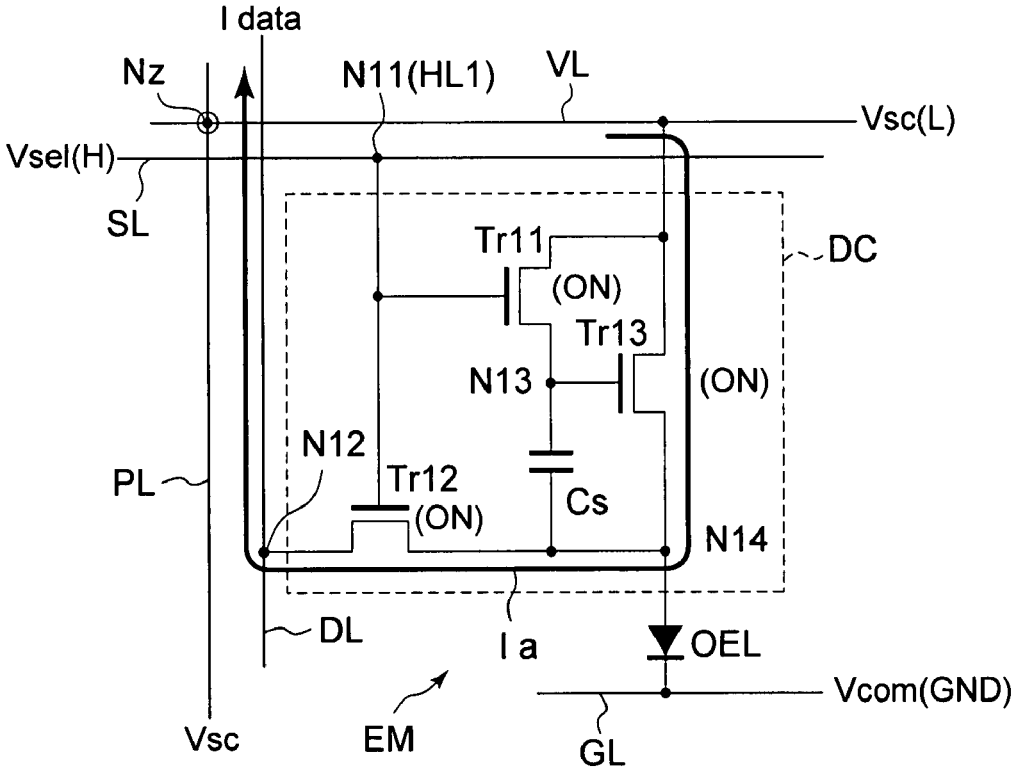
FIG. 8A is a conceptual diagram illustrating a data writing operation in the display pixels (pixel drive circuits) to be used in the embodiment.
Figure 8B:
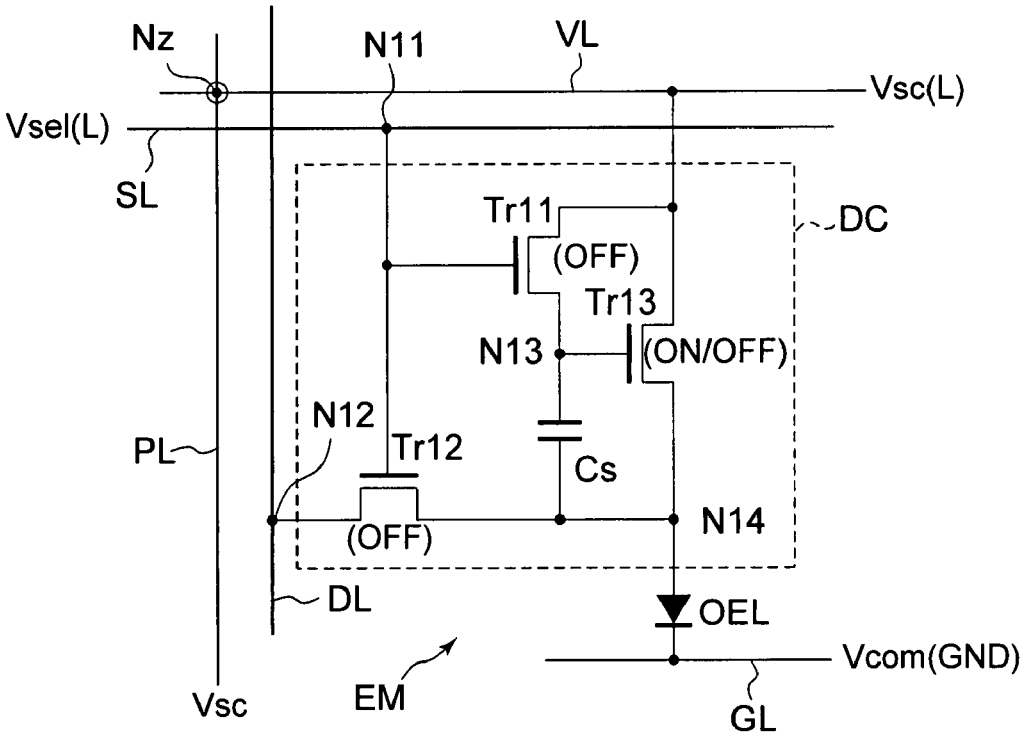
FIG. 8B is a conceptual diagram showing a non-emission operation not in the data writing operation in the display pixels (pixel drive circuits) to be used in the embodiment.
Figure 9:
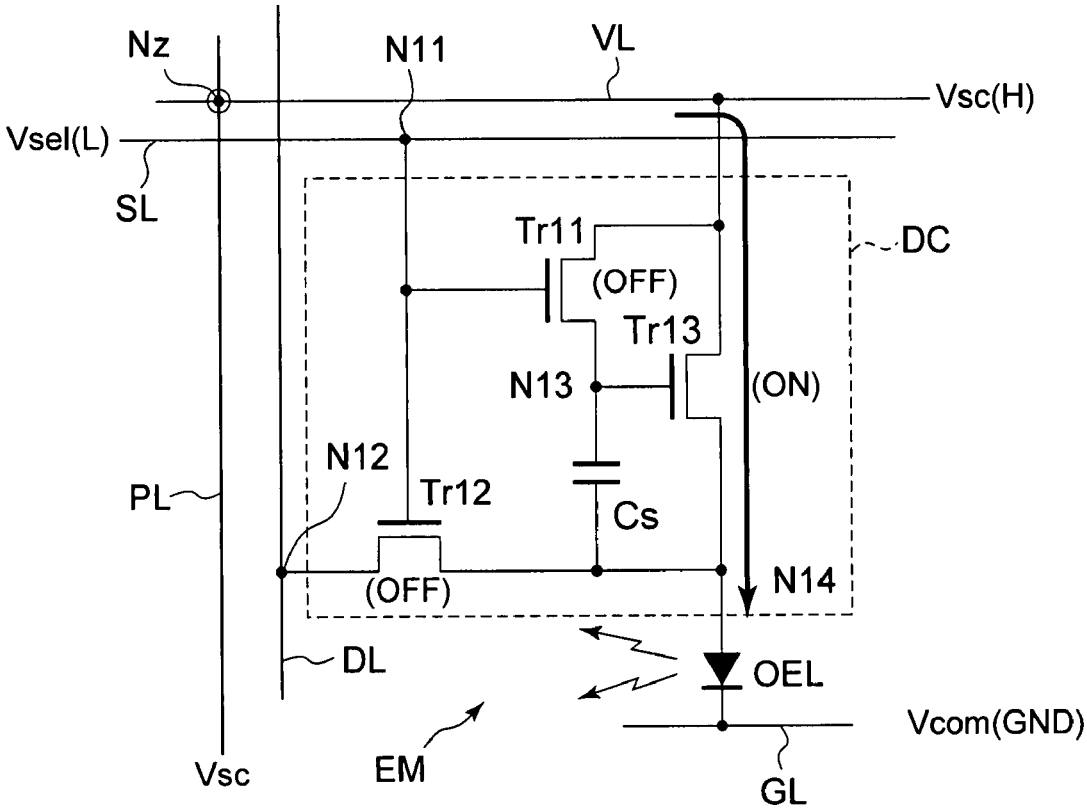
FIG. 9 is a conceptual diagram illustrating the light emission operation of the display pixels (pixel drive circuits) to be used in the embodiment.

FIG. 7 is a timing chart illustrating a drive control method for display pixels (pixel drive circuits) to be used in the embodiment. FIGS. 8A and 8B are conceptual diagrams illustrating the data writing operation and non-emission operation in the display pixels (pixel drive circuits) to be used in the embodiment. FIG. 9 is a conceptual diagram illustrating the light emission operation of the display pixels (pixel drive circuits) to be used in the embodiment.

The drive control method for the display pixels EM having the pixel drive circuit DC shown in FIG. 6 is set in such a way that a predetermined one process cycle period Tcyc includes a write period Twrt and an emission period Tem (Tcyc>Twrt+Tem), as shown in, for example, FIG. 7. In the write period Twrt, the display pixels EM are set in a selected state, and the gradation current Idata having a current value corresponding to display data is supplied thereto so that the voltage component corresponding to the display data is held between the gate and source (in the capacitor Cs) of the transistor Tr13 for emission drive provided in the pixel drive circuit DC. In the emission period Tem, the emission drive current having a current value corresponding to the display data is let to flow to the organic EL device OEL based on the voltage component held between the gate and source of the transistor Tr13 in the write period Twrt, causing the organic EL device OEL to perform emission of a predetermined luminance gradation.

A non-emission period Tnem (non-display period) where the supply of the emission drive current to the organic EL device OEL is cut off to disable light emission is set in that period in the one process cycle period Tcyc excluding the emission period Tem (including the write period Twrt) (Tcyc≧Tem+Tnem, Tnem>Twrt). The relationship between the write period Twrt and the non-emission period Tnem is not limited to a case where the write period Twrt is set at the head of the non-emission period Tnem as shown in FIG. 7. That is, as will be explained later in the description of the drive control method (display drive method) for the display apparatus, the write period Twrt may be set to an arbitrary time position in the non-emission period Tnem.

The one process cycle period Tcyc according to the embodiment is set to a period needed for the display pixels EM, for example, to display image information for one pixel in one frame (one screen) of images. That is, as will be explained later in the description of the drive control method for the display apparatus, when one frame of images is displayed on the display panel 110 having a plurality of display pixels EM two-dimensionally arrayed in rows and columns, the one process cycle period Tcyc is set to a period needed for one row of display pixels EM to display one row of images in one frame of images.

(Write Period)

First, in the write period Twrt, the scan signal Vse1 of the select level (ON level on) is applied to the scan lines SL from the scan driver 120, thereby rendering the display pixels EM in a selected state as shown in FIGS. 7 and 8A. At the same time, the supply voltage Vsc (=Vs) of the low level L is applied to the power source lines VL via the power supply lines PL from the power source drivers 140A, 140B.

In synchronism with the selection timing, the data driver 130 lets the gradation current Idata having a current value corresponding to display data flow into the pixel drive circuit DC. The data driver 130 is a circuit which controls the current value of the gradation current Idata flowing to the pixel drive circuit DC. When the gradation current Idata flows to the pixel drive circuit DC and the data lines DL, the potential of the data lines DL becomes lower than the supply voltage Vsc of the low level L.

As a result, the transistors Tr11 and Tr12 provided in the pixel drive circuit DC are turned on, applying the supply voltage Vsc of the low level L to the gate terminal of the transistor Tr13 (node N13; one end of the capacitor Cs) via the transistor Tr11 and causing the source terminal of the transistor Tr13 (node N14; the other end of the capacitor Cs) to be electrically connected to the data line DL via the transistor Tr12.

The data line DL becomes lower in potential than the power source line VL when the gradation current Idata is supplied. Accordingly, the gradation current Idata flows to the pixel drive circuit DC and the data line DL in order from the lead wire APL and/or the lead wire BPL via the power supply line PL and the power source line VL, so that the gradation current Idata flows to the data driver 130. Then, a voltage lower in potential than the supply voltage Vsc of the low level L is applied to the source terminal of the transistor Tr13 (node N14; the other end of the capacitor Cs).

In this manner, when the data driver 130 forcibly lets the gradation current Idata having the desired current value corresponding to display data flow between the drain and source of the transistor Tr13, the potential difference between the nodes N13 and N14 (between the gate and source of the transistor Tr13) becomes a potential difference according to the current value of the gradation current Idata. In other words, the potential difference is converged to the potential difference that allows the gradation current Idata having the desired current value to flow between the drain and source of the transistor Tr13. The then gradation current Idata is called "write current Ia".

At this time, charges corresponding to the potential difference between the nodes N13 and N14 (between the gate and source of the transistor Tr13) are stored and held as a voltage component in the capacitor Cs (see a potential Vc across the capacitor Cs in FIG. 7). The supply voltage Vsc (=Vs) of the low level L (equal to or lower than the ground potential GND) is applied to the power source line VL, and the write current Ia is controlled to flow in the direction of the data line DL, so that the potential to be applied to the anode terminal (node N14) of the organic EL device OEL becomes lower than the potential Vcom (ground potential GND to be applied to the common voltage line GL) of the cathode terminal of the organic EL device OEL. Accordingly, a reverse bias voltage is applied to the organic EL device OEL, so that the emission drive current does not flow to the organic EL device OEL, which does not emit light (non-emission operation).

(Non-Writing and Non-Emission Period)

In the non-emission period Tnem other than the write period Twrt (specifically, periods which are set before and after the write period Twrt or a period which is set before or after the write period Twrt), as shown in FIG. 7 and FIG. 8B, the scan signal Vse1 of the non-select level is applied to the scan line SL from the scan driver 120 (the scan signal Vse1 is blocked) to set the associated display pixel EM in an unselected state. In the non-emission period Tnem other than the write period Twrt, the supply voltage Vsc (=Vs) of the low level L is applied to the power source line VL from the power source drivers 140A and 140B via the power supply line PL. When the aforementioned writing operation has been executed immediately before the non-emission period Tnem other than the write period Twrt, the supply of the gradation current Idata from the data driver 130 is blocked in synchronism with the non-select timing, thereby disabling the acquisition of the gradation current Idata.

As a result, the transistors Tr11 and Tr12 provided in the pixel drive circuit DC are set off. This electrically disconnects the gate terminal of the transistor Tr13 (node N13; one end of the capacitor Cs) from the power source line VL, and electrically disconnects the source terminal of the transistor Tr13 (node N14; the other end of the capacitor Cs) from the data line DL. When the writing operation has been executed immediately before the non-emission period Tnem other than the write period Twrt, charges stored in the write period Twrt are held in the capacitor Cs.

Accordingly, the ON/OFF state of the transistor Tr13 is set based on the potential difference held between the nodes N13 and N14 (between the gate and source of the transistor Tr13; across the capacitor Cs). Regardless of the operational state of the transistor Tr13, however, the supply voltage Vsc (=Vs) of the low level L (equal to or lower than the ground potential GND) is applied to the power source line VL, and the node N14 is set blocked from the data line DL. Therefore, the potential to be applied to the anode terminal (node N14) of the organic EL device OEL is set equal to or lower than the potential Vcom (ground potential GND) of the cathode terminal of the organic EL device OEL. Accordingly, a reverse bias voltage is applied to the organic EL device OEL, so that the emission drive current does not flow to the organic EL device OEL, which does not emit light (non-emission operation).

(Emission Period)

Next, in the emission period Tem, as shown in FIG. 7 and FIG. 9, as in the non-emission period Tnem other than the write period Twrt, the scan signal Vse1 of the OFF level off is applied to the scan line SL from the scan driver 120 to set the associated display pixel EM in an unselected state and to set the supply of the gradation current Idata from the data driver 130 blocked. In the emission period Tem, the supply voltage Vsc (=Ve) of the high level H is applied to the power source line VL from the power source drivers 140A and 140B via the power supply line PL.

When the scan signal Vse1 of the OFF level off is applied to the scan line SL, the transistors Tr11 and Tr12 provided in the pixel drive circuit DC are turned off (or kept off). This blocks the application of the supply voltage Vsc to the gate terminal of the transistor Tr13 (node N13; one end of the capacitor Cs), and blocks the application of the voltage level, originated from the acquisition of the gradation current Idata, to the source terminal of the transistor Tr13 (node N14; the other end of the capacitor Cs) or keeps the application of the voltage level blocked. Accordingly, charges stored in the write period Twrt are held in the capacitor Cs.

The potential difference between the nodes N13 and N14 (between the gate and source of the transistor Tr13; across the capacitor Cs) is held this way, and the transistor Tr13 keeps the ON state. The supply voltage Vsc higher in potential than the common voltage Vcom (ground potential GND) is applied to the power source line VL. Therefore, the potential to be applied to the anode terminal (node N14) of the organic EL device OEL becomes higher than the potential of the cathode terminal of the organic EL device OEL.

Therefore, a predetermined emission drive current Ib flows to the organic EL device OEL from the power source line VL in the forward bias direction via the transistor Tr13 and the node N14, so that the organic EL device OEL emits light. The voltage component held in the capacitor Cs (the potential Vc across the capacitor Cs) is equivalent to the potential difference when the write current Ia corresponding to the gradation current Idata flows in the transistor Tr13. Accordingly, the emission drive current Ib flowing to the organic EL device OEL has a current value equivalent to the write current Ia (Ib*=Ia). Therefore, the display pixel EM (organic EL device OEL) emits light of a predetermined luminance gradation according to display data (gradation current Idata).

The display pixel EM (pixel drive circuit DC) according to the embodiment lets the gradation current Idata (write current Ia) designating a current value corresponding to display data flow between the drain and source of the transistor Tr13 for emission drive. Based on the voltage component held between the between the gate and source of the transistor Tr13 according to the current value of the gradation current Idata; the emission drive current Ib which flows to the organic EL device (light emitting device) OEL is controlled. Such control can ensure the use of the drive control method of the current gradation designation type which permits emission with a predetermined luminance gradation.

In the current gradation designation type, the current value of the current which flows to the organic EL device OEL is controlled by a current signal, not only by a voltage signal. Even if the resistance of the transistor Tr13 or the like increases (e.g., if the threshold of the gate voltage changes), the data driver 130 forcibly sets the write current Ia flowing to the transistor Tr13 to have the desired current value. This makes it possible to suppress the problem such that the emission drive current Ib becomes considerably smaller.

Although the foregoing description of the embodiment has been given of the drive control method of the current gradation designation type, the invention is not limited to this type. For example, the display apparatus may have a circuit configuration adapted to the drive control method of the voltage gradation designation type. Note that the voltage gradation designation type allows the emission drive current whose current value corresponds to display data to flow to the light emitting device of each display pixel by applying a gradation voltage having a voltage value corresponding to display data, thereby ensuring light emission with the desired luminance gradation. When the current value of the emission drive current Ib needed for emission is considerably small as required by the organic EL device OEL, however, the current value of the write current Ia becomes smaller too. In this respect, the display apparatus 100 of the current gradation designation type is particularly effective for the influence of the voltage drop on the display apparatus 100 is greater than that on the display apparatus of the voltage gradation designation type.

According to the display pixel EM (pixel drive circuit DC) of the embodiment, the single transistor Tr13 for emission drive, which constitutes the pixel drive circuit DC provided in each display pixel EM can realize both the voltage holding function and the emission drive function. The voltage holding function is to hold (store) the voltage component (charges) corresponding to the level of the gradation current Idata corresponding to display data into the capacitor Cs. The emission drive function is to control the current value of the emission drive current Ib to be supplied to the organic EL device OEL based on the voltage component held in the capacitor Cs and the supply voltage Vsc. As the single transistor achieves both functions, it is possible to stably achieve the desired emission characteristic over a long period of time without being influenced by a variation in the operational characteristic of each transistor constituting the pixel drive circuit DC.

Although the pixel drive circuit DC provided in each display pixel EM has a circuit configuration having three thin-film transistors Tr11 to Tr13 in the foregoing description of the embodiment, as shown in FIG. 6, the invention is not limited to this type. Specifically, the pixel drive circuit DC may have another circuit configuration as long as the pixel drive circuit (or the emission drive circuit) compatible with the current gradation designation type and use a single thin-film transistor to realize the voltage holding function and the emission drive function.

(Device Configuration of Display Pixel)

Next, a specific device configuration (planar layout and cross-sectional structure) of the display pixel EM (pixel drive circuit DC and organic EL device OEL) as shown in FIG. 5 and FIG. 6 will be explained.

Figure 10:
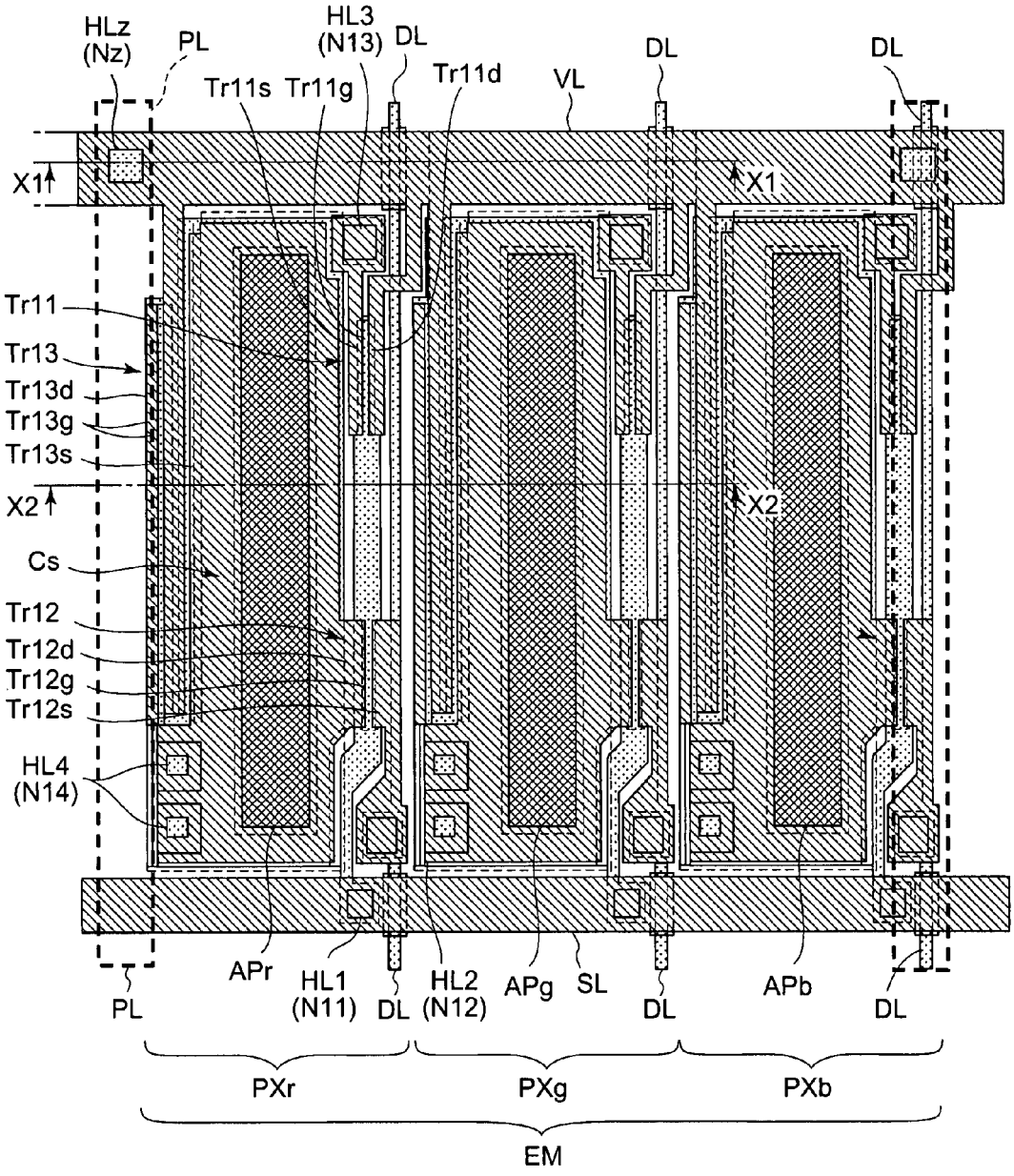
FIG. 10 is a plan layout view showing one example of the display pixels adaptable to the display apparatus (display panel) according to the embodiment.

FIG. 10 is a plan layout view showing one example of the display pixels adaptable to the display apparatus (display panel) according to the embodiment. FIG. 10 shows the plan layout of the display pixel EM including the three color pixels PXr, PXg, PXb of red (R), green (G) and blue (B) shown in FIG. 5. FIG. 10 specifically and mainly shows the individual transistors of the pixel drive circuit DC and the layer on which individual wiring layers are formed.

Figure 11:
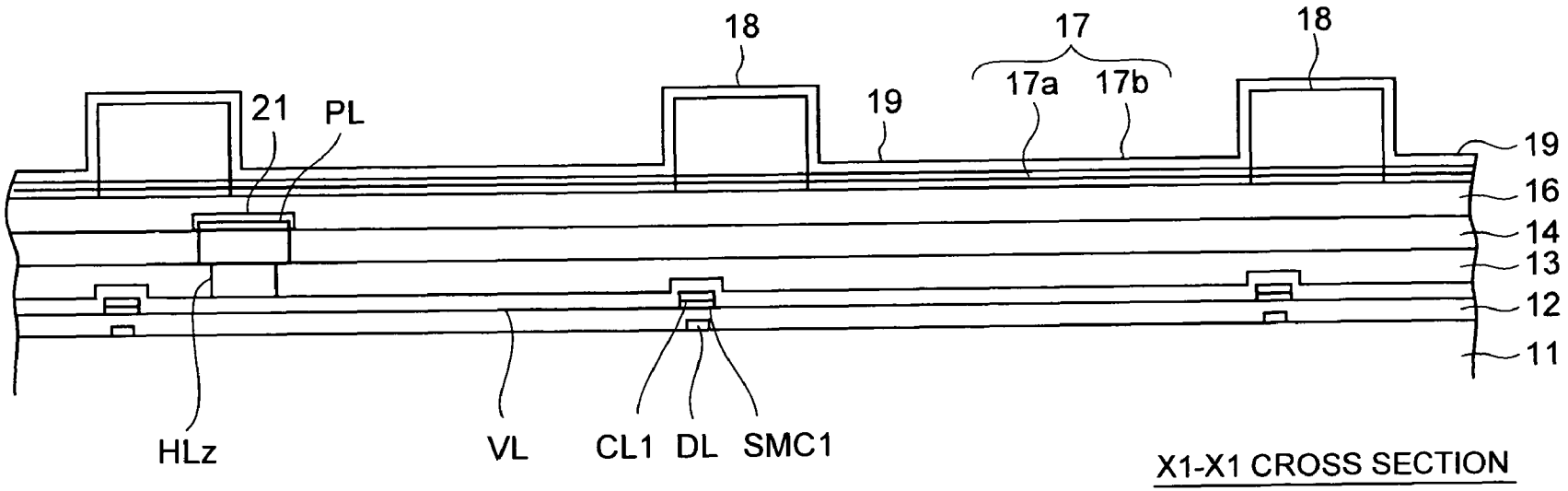
FIG. 11 is a schematic cross-sectional view showing the X1-X1 cross section of display pixels EM having the plan layout shown in FIG. 10.
Figure 12:
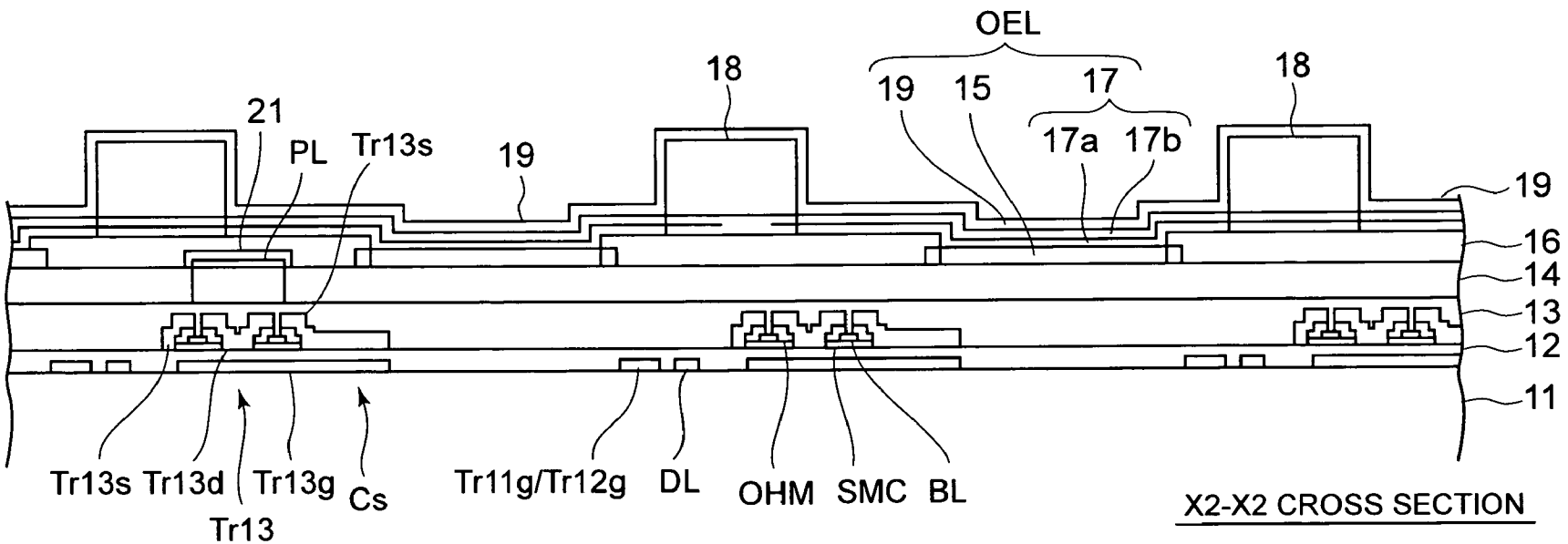
FIG. 12 is a schematic cross-sectional view showing the X2-X2 cross section of the display pixels EM having the plan layout shown in FIG. 10.

FIGS. 11 and 12 are schematic cross-sectional views respectively showing the X1-X1 cross section and X2-X2 cross section of display pixels EM having the plan layout shown in FIG. 10. In the embodiment, an organic EL device having an organic EL layer formed of a polymer organic material is used as the organic EL device OEL provided in each display pixel EM. In this case, the temperature condition used in a heat treatment which is performed in the process of forming a transistor (thin-film transistor) provided in the pixel drive circuit DC is higher than the temperature range (heatresistant temperature) at which the characteristic of the polymer organic material can be maintained. Therefore, the individual transistors and the individual wiring layers or the like of the pixel drive circuit DC are formed later than the fabrication process for the organic EL device OEL, and are provided closer to the insulative substrate than the organic EL device OEL.

In the display pixel EM (color pixels PXr, PXg, PXb) shown in FIGS. 5 and 6, specifically, the power source line VL, the scan line SL, the data line DL and the power supply line PL are laid out in the pixel forming area (areas of forming the color pixels PXr, PXg, PXb) set on one surface side of the insulative substrate. The power source line VL is laid out so as to extend along the upper edge area of the planar layout shown in FIG. 10 in the left and right direction in the diagram. The scan line SL is laid out so as to extend along the lower edge area of the planar layout shown in FIG. 10 in the left and right direction in the diagram. The data line DL is laid out so as to intersect those lines VL and SL and extend along the right edge area of each color pixel PXr, PXg, PXb of the planar layout shown in FIG. 10 in the up and down direction in the diagram. The power supply line PL is laid out so as to extend along the left or right edge area of the display pixel EM including the color pixels PXr, PXg, PXb (along the left edge area of the color pixel PXr in FIGS. 10, 11 and 12) in the up and down direction in FIG. 10. The power supply line PL is connected to the power source line VL via the contact hole Hlz (equivalent to the aforementioned Nz).

As shown in FIGS. 10, 11 and 12, the scan line SL and the power source line VL are provided lower than the power supply line PL (closer to the insulative substrate 11), and the data line DL is provided lower than the scan line SL and the power source line VL. The scan line SL and the power source line VL are formed together with the sources and drains of the transistors Tr11 to Tr13 by patterning the source and drain metal layers for forming the sources and drains of the transistors Tr11 to Tr13. The data line DL is formed by patterning the gate metal layers for forming the gates of the transistors Tr11 to Tr13.

As shown in FIGS. 11 and 12, in the display pixel EM, first, gate electrodes Tr11*g* to Tr13*g* of the transistors Tr11 to Tr13 and the data line DL are formed on the insulative substrate 11 in the same step. Thereafter, a semiconductor layer SMC of amorphous silicon, polysilicon or the like, and a block layer BL of an insulative material, such as silicon oxide or silicon nitride, are formed in order in each of areas corresponding to the gate electrodes Tr11*g* to Tr13*g* via a gate insulation film 12. Then, source electrodes Tr11*s* to Tr13*s* and drain electrodes Tr11*d* to Tr13*d* of the transistors Tr11 to Tr13, the scan line SL and the power source line VL are formed in the same step. The source electrode Tr11*s*, Tr12*s*, Tr13*s* and the drain electrode Tr11*d*, Tr12*d*, Tr13*d* are formed via an impurity layer OHM so as to extend both end portions of each associated semiconductor layer SMC.

Not only the gate insulation film 12 but also a parasitic capacitor layer SMC1 provided on the gate insulation film 12 and a parasitic capacitor layer CL1 provided on the parasitic capacitor layer SMC1 are intervened in the intersection area of the data line DL and the power source line VL. The parasitic capacitor layer SMC1 is formed by patterning the same layer as the semiconductor layer SMC in such a way that the layer remains in the intersection area. The parasitic capacitor layer CL1 is formed by patterning the same layer as the block layer BL in such a way that the layer remains in the intersection area. The data line DL is protected so as not to be interfered with the voltage to be applied to the power source line VL by increasing the distance between the data line DL and the power source line VL this way.

Next, after a protection insulation film 13 is formed on the entire region on the insulative substrate 11, the contact hole Hlz is formed to expose the top surface of the power source line VL and a contact metal is filled in the contact hole Hlz. Further, after a planarization film 14 is formed on the entire region on the insulative substrate 11, a wiring groove to expose the contact hole Hlz (contact metal) is formed. Then, a wiring metal is filled in the groove to form the power supply line PL.

This forms the pixel drive circuit DC including a plurality of transistors Tr11 to Tr13, the capacitor Cs (formed in an area where the gate electrode Tr13*g* and the source electrode Tr13*s* of the transistor Tr13 extend facing each other), the scan line SL, the power source line VL, the data line DL and the power supply line PL.

As shown in FIGS. 6 and 10, the scan line SL is electrically connected to the gate electrodes Tr11*g*, Tr12*g* of the transistors Tr11 and Tr12 via a contact hole H11 (equivalent to the node N11) formed in the gate insulation film 12. The data line DL is electrically connected to the source electrode Tr12*s* of the transistor Tr12 via a contact hole H12 (equivalent to the node N12) formed in the gate insulation film 12.

The source electrode Tr11*s* of the transistor Tr11, the gate electrode Tr13*g* of the transistor Tr13 and one side electrode of the capacitor Cs (on the insulative substrate 11 side) are electrically connected to one another via a contact hole H13 (equivalent to the node N13) formed in the gate insulation film 12. The power source line VL and the power supply line PL are electrically connected to each other via the contact hole HLz (equivalent to the node Nz) formed in the protection insulation film 13.

Further, the drain electrode Tr12*d* of the transistor Tr12, the source electrode Tr13*s* of the transistor Tr13 and the other side electrode of the capacitor Cs are electrically connected to a pixel electrode 15 of the organic EL device OEL, which will be described later, via a contact hole H14 (equivalent to the node N14) formed in the protection insulation film 13 and the planarization film 14.

A cap layer 21 is provided on the power supply line PL so as not to expose the power supply line PL. The cap layer 21 is formed by etching the same layer as that of the pixel electrode 15. The presence of the cap layer 21 prevents the power supply line PL from contacting an etchant at the time of patterning the cap layer 21 and the pixel electrode 15 with the etchant. That is, the cap layer 21 is provided to prevent a cell reaction from being caused by the etchant when the pixel electrode 15 contains a transparent conductive metal oxide like ITO and the power supply line PL contains a metal like Al.

Next, the pixel electrode (e.g., anode electrode) 15 is formed in each of organic-EL-device-OEL forming areas APr, APg, APb of the color pixels PXr, PXg, PXb on the planarization film 14. Thereafter, an interlayer insulation film 16 and an insulative bank (partition) 18 which insulate between the color pixels PXr, PXg, PXb (forming areas APr, APg, APb) are formed. Next, a polymer organic material is applied to an area defined by the bank 18, thereby forming an organic EL layer 17 constituting the organic EL device OEL of each color pixel PXr, PXg, PXb (e.g., a hole transport layer 17*a* and an electron transport layer 17*b*).

Next, the organic EL device OEL having a well-known device structure is formed by forming an opposing electrode (e.g., cathode electrode) 19 in an arbitrary area on the insulative substrate 11 including the forming areas APr, APg, APb and the bank 18. The display panel 110 may have a bottom emission structure or a top emission structure. In the bottom emission structure, light emitted from the organic EL layer 17 of each display pixel EM (color pixels PXr, PXg, PXb) is output toward the insulative substrate 11. In the top emission structure, light emitted from the organic EL layer 17 of the display pixel EM is output toward the opposing electrode 19. When the display panel 110 has the bottom emission structure, the pixel electrode 15 has a light transmission characteristic while the opposing electrode 19 has a light reflection characteristic.

When the display panel 110 has the top emission structure, the pixel electrode 15 has at least a light reflection characteristic while the opposing electrode 19 has a light transmission characteristic. In this case, the pixel electrode 15 may have an electrode structure including a single-layer conductive layer having a light reflection characteristic or may have a multilayer structure including, for example, a reflection metal layer and a transparent metal oxide layer.

In the cross-sectional structure of the display pixel EM as shown in FIGS. 11 and 12, a single-layer wiring layer is used for the source electrodes Tr11*s* to Tr13*s* and the drain electrodes Tr11*d* to Tr13*d* of the transistors Tr11 to Tr13. However, the invention is not limited to this particular case but may be adapted to a case where those source electrodes Tr11*s* to Tr13*s* and drain electrodes Tr11*d* to Tr13*d* have a multilayer structure including a plurality of wiring layers. The power supply line PL may have a wiring structure having the lamination of an underlying wiring layer filled in the wiring groove formed in the planarization film 14 and an overlying wiring layer formed in the same step as forming the pixel electrode 15 of the organic EL device OEL.

The planar layout of the display pixel EM as shown in FIG. 10 shows a case where the display pixel EM has a wiring structure such that the power source line VL which is connected to the power supply line PL via the contact hole Hlz continuously extends so as to be electrically connected to the adjoining display pixel. However, the invention is not limited to this type, and, for example, the power source line VL may be segmented for a predetermined number of display pixels EM. In this case, for each power source line VL (i.e., for each predetermined number of display pixels EM), the display pixel EM has a wiring structure such that the power source line VL is connected to the individual power supply line PL via the contact hole Hlz (node Nz).

<Drive Control Method for Display Apparatus>

Next, a drive control method (display drive method) for the display apparatus according to the invention will be explained.

Figure 14:
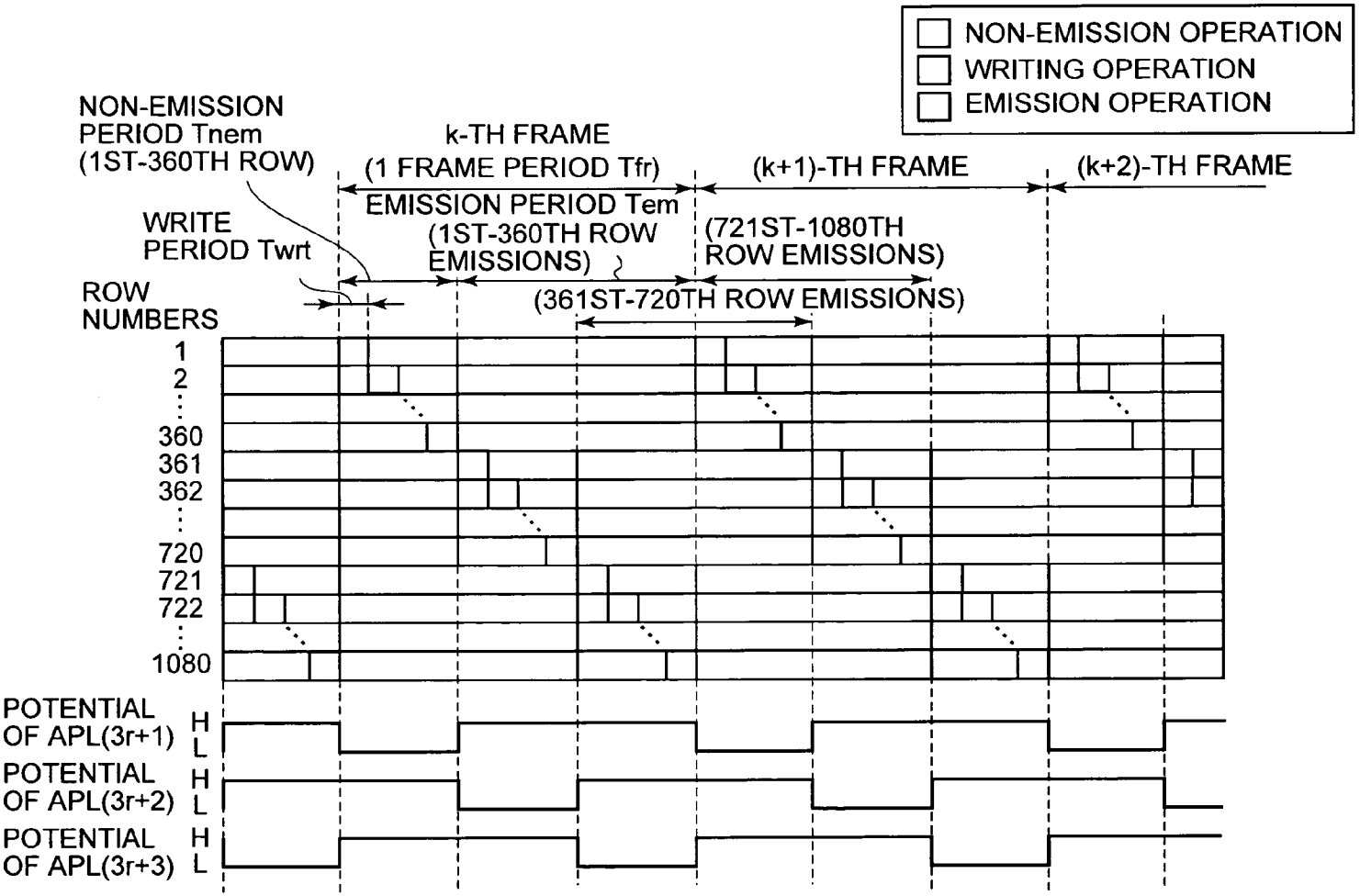
FIG. 14 is a timing chart exemplarily illustrating another example of the drive control method for the display apparatus according to the embodiment.

FIG. 14 is a timing chart exemplarily illustrating another example of the drive control method for the display apparatus according to the embodiment. In FIG. 14, k is a positive integer. Each hatched portion indicated by cross-meshing in each row represent the write period for display data. Each hatched portion indicated by dots represents the emission period.

The display drive method for the display apparatus 100 according to the embodiment is carried out as follows. An operation of writing the gradation current Idata corresponding to display data in each row of display pixels EM (pixel drive circuits DC) laid out in the display panel 110 is performed for every row. During the operation, plural rows of display pixels EM (organic EL devices OEL) in each of pixel blocks grouped beforehand are caused to perform, at a time, an emission operation with a predetermined luminance gradation corresponding to the display data (gradation current) at a predetermined timing. One screen of image information is displayed on the display panel 110 in this manner.

One example of the display drive method for the drive control method according to the embodiment will be illustrated below. As shown in FIGS. 2 and 5, in the display panel 110, the two-dimensionally arrayed display pixels EM including 1920 horizontal pixels×1080 vertical pixels are grouped into three pixel blocks each containing 360 rows. The pair of power source drivers 140A, 140B are provided facing each other with the display panel 110 in between. In the display panel 110, as shown in FIGS. 13 and 14, first, the pair of power source drivers 140A, 140B apply a supply voltage Vsc1 (=Vs) of the low level L to the power supply lines PL1, PL4, . . . , PL(3xr+1) at a time in the non-emission period Tnem in one frame period Tfr (k-th frame). As a result, the supply voltage Vsc1 of the low level L is applied to the all the power source lines VL1-VL360 included in the pixel block BL1 connected via the nodes Nz (contact holes Hlz) to the power supply lines PL1, PL4, . . . , PL(3xr+1).

Accordingly, the organic EL devices OEL provided in the display pixels EM included in the pixel block BL1 are set in a reverse bias state, regardless of whether or not the scan signal Vse1 of the select level (ON level on) is applied to the scan lines SL1-SL360 included in the pixel block BL1. Therefore, the current does not flow to the organic EL device OEL from the pixel drive circuit DC, thereby setting all the display pixels EM in a non-emission state (the display pixels EM do not emit light).

The write period Twrt (indicated by cross-meshing in FIG. 14) set in the non-emission period Tnem will be described next. In the write period Twrt, as shown in FIG. 7, the scan driver 120 applies the scan signal Vse1 of the select level (ON level on) is applied to the scan lines SL1-SL360 included in the pixel block BL1 in order. As a result, the display pixels EM in each row are set in a selected state in order.

In synchronism with the select timing, the gradation current Idata having a negative current value corresponding to display data is supplied to each data line DL from the data driver 130. In this state, the voltage component corresponding to the gradation current Idata is held (charges are stored) between the gate and source of the transistor Tr13 (across the capacitor Cs) provided in the pixel drive circuit DC of each of the display pixel EM in the row set in the selected state. When the write period Twrt ends, the scan driver 120 applies the scan signal Vse1 of the non-select level (OFF level off) to the scan lines SL set in the selected state. At this timing, the transistor Tr11 is turned off, and the voltage component between the gate and source of the transistor Tr13 is held (display data is written).

This writing operation is sequentially performed on all rows of display pixels EM included in the pixel block BL1 in such a way that the writing operations do not overlap in terms of time. After writing to the display pixels EM is finished for all the rows included in the pixel block BL1, the voltage level of the supply voltage Vsc1 to be applied to the power supply lines PL1, PL4, . . . , PL(3xr+1) from the power source drivers 140A, 140B is changed from the low level L to the high level H (=Ve) (see the emission period Tem to be described later).

In synchronism with the timing, or after the timing, the power source drivers 140A, 140B apply a supply voltage Vsc2 (=Vs) of the low level L to the power supply lines PL2, PL5, . . . , PL(3xr+2). As a result, the supply voltage Vsc2 is applied to all the power source lines VL361-VL720 included in the pixel block BL2, thus setting each row of display pixels EM in a non-emission state. In the non-emission state of the pixel block BL2, as in the case of the pixel block BL1, the operation of holding the voltage component corresponding to display data in each row of display pixels EM is executed sequentially.

For all the rows of display pixels EM included in the pixel block BL3, likewise, the power source drivers 140A, 140B apply a supply voltage Vsc3 of the low level L to the power source lines VL721-VL1080 via the power supply lines PL3, PL6, . . . , PL(3xr+3). As a result, the display pixels EM in each row are set in a non-emission state, and the operation of holding the voltage component corresponding to display data in the display pixels EM is sequentially executed row by row.

Accordingly, display data is sequentially written in all the two-dimensionally arrayed display pixels EM of the display panel 110, row by row.

Next, a description will be given of the emission period Tem (indicated by dot hatching in FIG. 14) which is set in the pixel block for which the non-emission period Tnem (including the writing period Twrt) have ended (e.g., pixel block BL1). In the emission period Tem, as shown in FIG. 7, the scan driver 120 applies the scan signal Vse1 of the non-select level (OFF level off) to all the scan lines SL1-SL360 included in the pixel block BL1 at a time, thereby setting the scan lines SL1-SL360 in an unselected state. At the same time, the data driver 130 blocks the supply of the gradation current Idata to the data lines DL.

In synchronism with the timing, the power source drivers 140A, 140B simultaneously apply a supply voltage Vsc1 (=Ve) of the high level H to the power supply lines PL1, PL4, . . . , PL(3xr+1). As a result, the supply voltage Vsc1 of the high level H is applied to all the power source lines VL1-VL360 included in the pixel block BL1 connected to the power supply lines PL1, PL4, . . . , PL(3xr+1) via the nodes Nz (contact holes Hlz).

Accordingly, the organic EL devices OEL of all the display pixels EM included in the pixel block BL1 are set in a forward bias state. Based on the voltage component (written display data) held in each display pixel EM (between the gate and source of the transistor Tr13 for emission drive) in the above-described writing operation, the emission drive current Ib corresponding to display data (gradation current Idata) flows to the organic EL device OEL from the pixel drive circuit DC. Therefore, all the display pixels EM in the pixel block BL1 emit lights of a predetermined luminance gradation at a time (are set in an emission state).

This emission operation is continuously executed in the next one frame period ((k+1)-th frame) Tfr to the timing at which the operation of writing one screen of display data in each row of display pixels EM (i.e., the timing, or before the timing, of starting the write period Twrt for one row of display pixels EM included in the pixel block BL1). This emission operation of causing all the display pixels EM included in each of the pixel blocks BL1 to BL3 to perform an emission operation at a time. As a result, image information based on one screen (k-th frame) of display data is displayed on the display panel 110.

Thereafter, a sequence of display drive operations including the aforementioned non-emission operation (including the writing operation) and emission operation are repeatedly executed in the next (k+1)-th frame or subsequent frames too.

According to the drive control method for the display apparatus, in the period where the writing operation to each row of display pixels included in the same pixel block is sequentially executed, the display pixels (light emitting devices) included in that pixel block do not perform an emission operation, and can be set in a non-emission state (non-display state). This makes it possible to realize the display drive control of a pseudo-impulse type which performs emission with a luminance gradation corresponding to display data only in a given period (emission period excluding the non-emission period) in one frame period.

In the timing chart illustrated in FIG. 14, particularly, the 1080 rows of display pixels EM constituting the display panel 110 are grouped into three pixel blocks BL1 to BL3, and the non-emission operation and the emission operation are executed at a time at different timings for the respective pixel blocks. Therefore, the ratio of the non-display period (the ratio of inserting black) in the non-emission operation in one frame period Tfr can be set to approximately 33%. For the human visual sense to clearly see a dynamic image without blurring or bleeding, generally, the tentative target of the black inserting ratio is approximately 30% or greater. Therefore, the embodiment can realize a display apparatus capable of displaying a dynamic image with a good display quality.

Further, in the display pixels and the drive control method (display drive method) according to the embodiment, the pair of power source drivers 140A, 140B are arranged facing each other in the column direction (upward and downward in the diagram) of the display panel 110 with the display panel 110 having the aspect ratio of 16:9 for the wide screen (having, for example, 1920 horizontal display pixels×1080 vertical display pixels) in between. The power source drivers 140A, 140B simultaneously apply the same supply voltage Vsc (Vsc1, Vsc2, Vsc3) to one end side and the other end side of each power supply line PL, thereby applying the supply voltage Vsc to all the power source lines VL included in a specific pixel block. All the display pixels EM included in the pixel block are set in a non-emission state or in an emission state at a time.

The display apparatus has power supply lines PL corresponding to the number of the pixel blocks preset for the display panel 110, and a predetermined supply voltage Vsc is applied from both ends of a plurality of power supply lines PL commonly connected to all the power source lines VL included in each pixel block. This makes it possible to surely set the length of the supply-voltage supply path (wiring length) shorter as compared with the system of supplying the supply voltage from one lengthwise end of the display panel to the power source lines. Therefore, the number of display pixels which are substantially driven for emission by the pixel current (dot current) supplied from a single power supply line PL can surely be made smaller than the number of the display pixels in one row.

Specifically, in the display panel compatible with the aspect ratio for the wide screen having 1920 horizontal pixels×1080 vertical pixels, when each display pixel includes three RGB color pixels, the number of pixels connected to each power source line becomes 1920 pixels×3 colors=5760 pixels. In the case of applying the supply voltage from one end side of the power source lines laid out in the row direction, it is necessary to supply the power source lines with the current large enough to simultaneously drive all the display pixels (5760 pixels). For the sake of descriptive convenience, the configuration of this system is referred to as "comparative example".

In the display apparatus according to the embodiment, the two-dimensionally arrayed display pixels of the display panel are grouped (separated) into a plurality of pixel blocks each consisting of a predetermined number of rows beforehand. The supply voltage is applied to the power source lines for each pixel block via a plurality of power supply lines arranged in the column direction. The power supply lines are so set as to be connected to the display pixels via the power source lines so that the number of pixels to which the current is supplied over a single power source line (strictly speaking, the number of pixels which are substantially driven by the current) is made smaller than that of the comparative example (i.e., 5760 pixels).

When the number of segments of the display panel (the number of pixel blocks) is set to 3, the number of all the pixels (the number of rows) in the column direction is 1080, so that the number of pixels in the column direction included in each pixel block (the number of power source lines) becomes 1080/3=360 pixels. In a specific pixel block, therefore, the number of the pixels in the row direction in which the current is supplied by a single power supply line is set to or less than 5760/360=16 pixels. This setting can make the density of the current to be supplied to the power supply line can be made smaller than that of the comparative example.

In other words, the total number of pixels in the row direction (horizontal direction) of the display panel in which the current is supplied by a single power supply line is set to or less than NC×NA/NS where NC is the total number of pixels in the row direction (horizontal direction) of the display panel, NA is the number of segments of the display panel (the number of pixel blocks), and NS the number of rows (number of scan lines) panel. The display panel (FIG. 5, FIG. 15) according to the above-described embodiment is based on this technical concept. The display panel shown in FIG. 5, for example, is separated into three (NA=3). Accordingly, every 3×NA other of the display pixels (color pixels) laid out in the row direction are connected to the power supply line PL via the node Nz. Here, 3×NA<16/9×3×NA(=NC×NA/NS), so that according to the display panel of the embodiment, the number of pixels (the number of pixels which are substantially driven by the current) to which the current is supplied by a single power supply line (corresponding to a power source line in the related art) can surely be made smaller than that of the comparative example (1920 RGB).

According to the embodiment, therefore, it is possible to surely shorten the path along which the supply voltage is applied to the display pixels and to surely set shorter the number of display pixels to which the pixel current is supplied accordingly. This makes it possible to suppress the voltage drop of the supply voltage and the delay of the application timing thereof, thus permitting the emission drive current having the adequate current value corresponding to display data to flow to the light emitting devices and ensuring an emission operation with the adequate luminance gradation. It is therefore possible to realize a display apparatus having an excellent display quality.

The foregoing description of the embodiment has been given of the case where the display pixels EM in each row are commonly connected to a single power source line VL, and are connected to a plurality of power supply lines via nodes Nz for each pixel block, at predetermined intervals (with every predetermined number of pixels−1 in the pixel block being excluded). However, the invention is not limited to this type, and the power source lines may be separated in each pixel block for every display pixel which can substantially be driven for emission by the pixel current originated from the supply voltage Vsc supplied by each power supply line.

Next, a description will be given of another example of the display panel to be used for the display apparatus according to the embodiment, and a drive control method therefor, with reference to the accompanying drawings.

Figure 15:
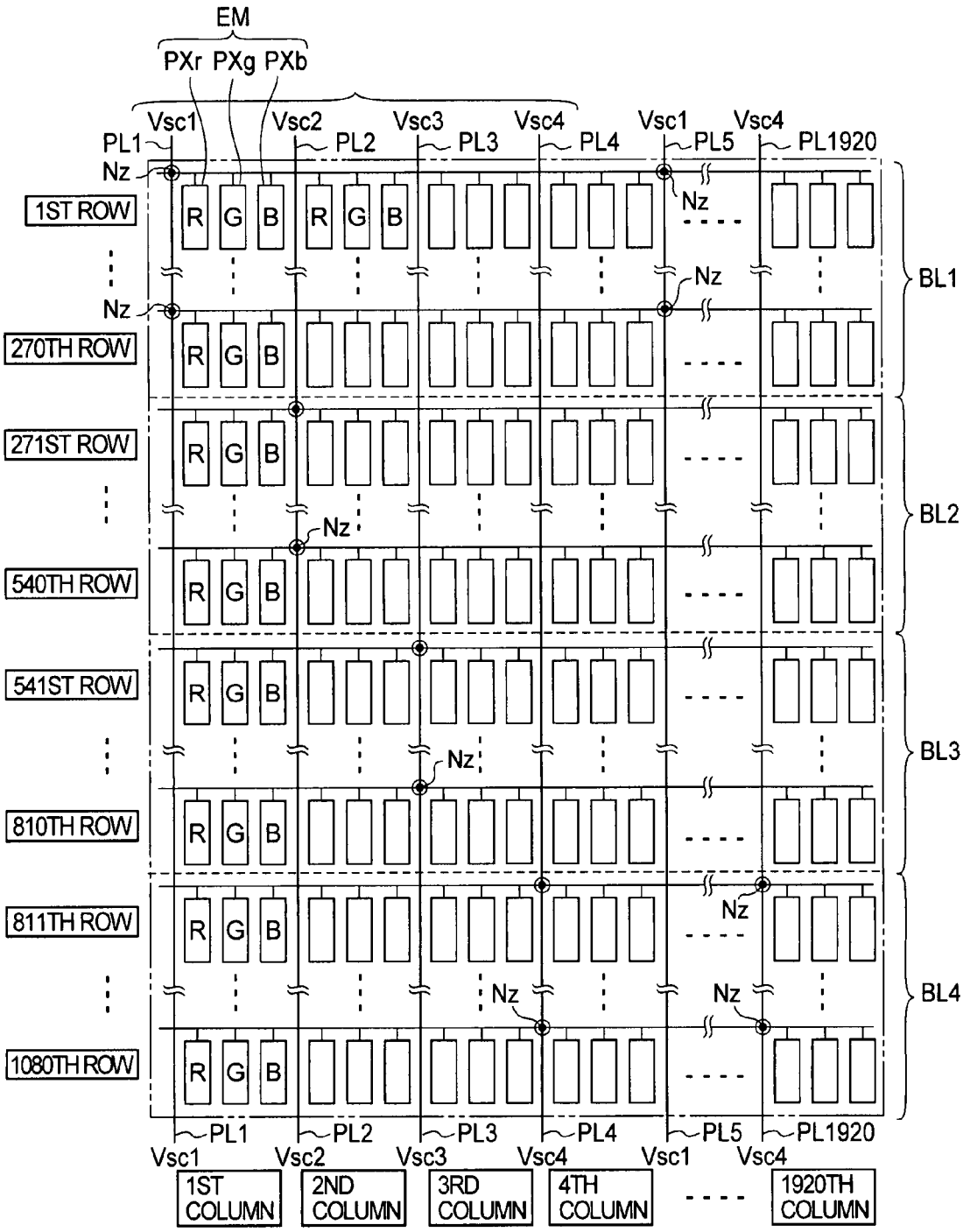
FIG. 15 is a schematic plan view showing another example of the array of pixels of the display panel to be used in the display apparatus according to the embodiment.
Figure 16:
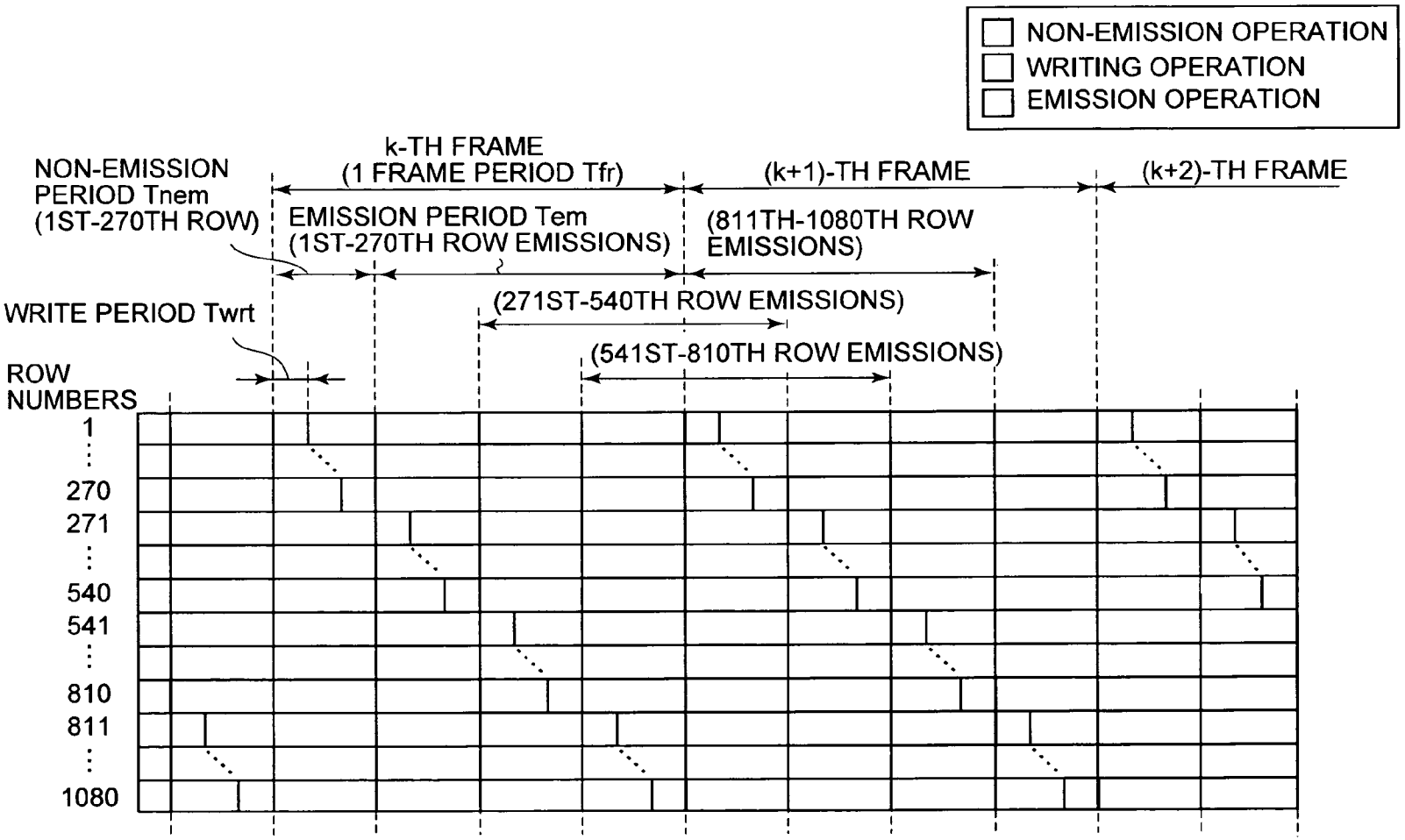
FIG. 16 is a timing chart exemplarily illustrating a further example of the drive control method for the display apparatus according to the embodiment.

FIG. 15 is a schematic plan view showing another example of the array of pixels of the display panel to be used in the display apparatus according to the embodiment. FIG. 16 is a timing chart exemplarily illustrating a further example of the drive control method for the display apparatus according to the embodiment. Those portions of the configuration and drive control method which are equivalent to the corresponding portions of the display panel will not be described.

In the display apparatus equipped with the display panel and the drive control method therefore (FIGS. 2 to 14), the two-dimensionally arrayed display pixels EM of the display panel 110 are grouped into three pixel blocks (pixel block BL1 having the first to 360-th rows, pixel block BL2 having the 361st to 720 rows, and pixel block BL3 having the 721st to 1080-th rows in FIG. 5). The display panel is controlled in such a way that the non-emission operation (including the writing operation) and the emission operation are executed at a time at different timings for the respective pixel blocks. However, the invention is not limited to this case, and the display pixels EM may be grouped into a different number of pixel blocks.

Specifically, as shown in FIG. 15, for example, the two-dimensionally arrayed display pixels EM of the display panel 110 are grouped into four pixel blocks BL1 to BL4 (pixel block BL1 having the first to 270-th rows, pixel block BL2 having the 271st to 540-th rows, pixel block BL3 having the 541st to 810-th rows, and pixel block BL4 having the 818-th to 1080-th rows). The pair of power source drivers 140A, 140B (not shown; see FIGS. 1 and 2) provided facing each other at upper and lower portions of the display panel 110 apply the supply voltages Vsc (Vsc1-Vsc4) of predetermined voltage levels to the pixel blocks BL1 to BL4 via the individual power supply lines PL. In this manner, the display panel may be controlled in such a way that the non-emission operation (including the writing operation) and the emission operation are executed at a time at different timings for the respective pixel blocks BL1-BL4.

In this case, the ratio of the non-display period (the ratio of inserting black) in the non-emission operation in one frame period Tfr becomes 25%. While this ratio is slightly lower than 30% which is the tentative target, a display apparatus having a relatively good display quality can be realized.

A description will now be given of specific evaluation on the degree of the voltage drop of the supply voltage in each of the display panels (FIG. 2 and FIG. 15) of the embodiment.

Figure 17:
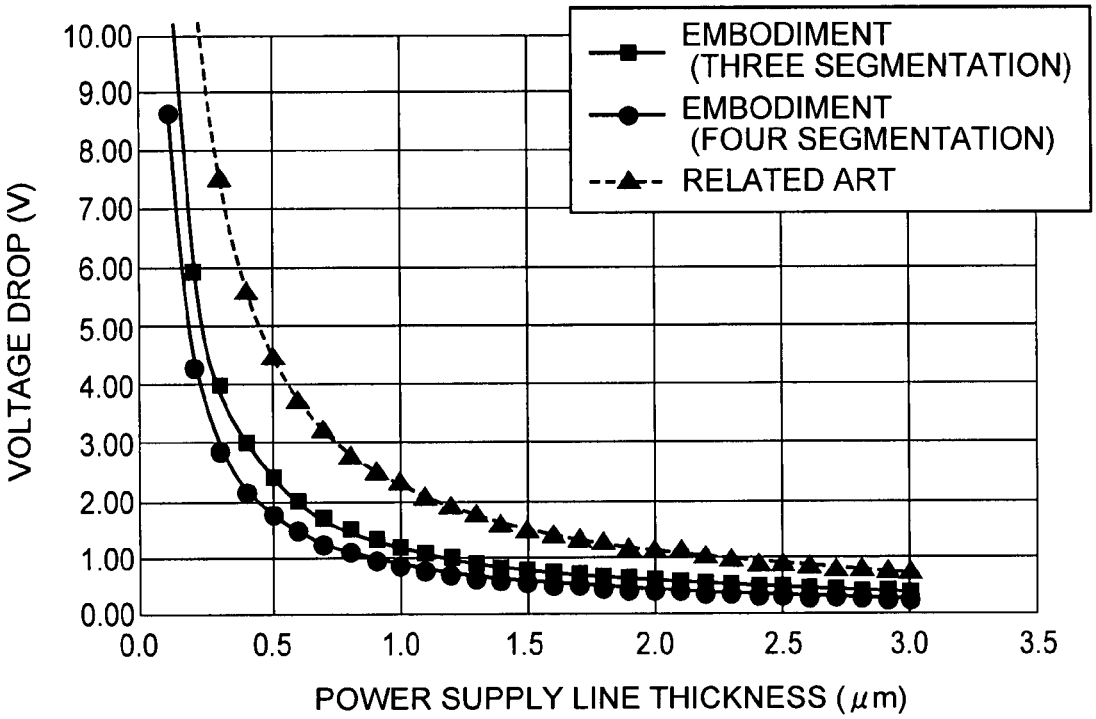
FIG. 17 shows experimental results showing the levels of voltage drops of the supply voltage in the display panel to be applied to the display apparatus according to the embodiment.

FIG. 17 shows experimental results showing the levels of voltage drops of the supply voltage in the display panel to be applied to the display apparatus according to the embodiment. An experiment was conducted under the conditions such that in the display panel having the wide aspect ratio (16:9) including 1920 horizontal pixels×1080 vertical pixels (each display pixel including RGB three color pixels as in FIG. 5), the power supply lines PL and the power source lines VL both had a wiring width of 30 μm and an electrically resistivity of 3 mΩcm, the pixel current (dot current) of 5 μA originating from the supply voltage was supplied to all the pixels at a time. FIG. 17 shows the results of measuring the relationship between the film thickness of the power source lines and the voltage drop of the supply voltage in a case where the pixel current originating from the supply voltage is supplied from one end sides of the power source lines laid out in the lengthwise direction (row direction) of the display panel, and in a case where the pixel current originating from the supply voltage is supplied to the power source lines from both ends sides of the power supply lines laid out in the short-side direction (column direction) of the display panel via nodes (contact holes). The voltage drop here is the voltage drop of wires where the voltage drop is most significant. In the embodiment, for example, this voltage drop corresponds to the voltage drop between the upper end portion and the center portion (the portion at equal distances from the upper end portion and the lower end portion) of the power supply line PL, or the voltage drop between the lower end portion and the center portion in FIG. 3. Likewise, in the comparative example (conventional configuration), this voltage drop corresponds to the voltage drop between the left end portion of the supply voltage line Vp and the center portion thereof in the left and right direction, or the voltage drop between the right end portion and the center portion in the left and right direction.

In the evaluation, the case where the two-dimensionally arrayed display pixels are grouped into three pixel blocks (three segmentations) as shown in FIG. 2 of the embodiment, and the case where the two-dimensionally arrayed display pixels are grouped into four pixel blocks as shown in FIG. 15 (four segmentations) are compared with the comparative example. As shown in FIG. 17, it is found that the voltage drop is reduced to approximately a half or smaller in the three segmentation case or the four segmentation case of the embodiment as compared with the comparative example, regardless of the film thickness.

According to the display panel of the embodiment, it is found that the four segmentation case makes the degree of the voltage drop smaller than the three segmentation case.

It is therefore proved that in the display panel having the wide aspect ratio (16:9) (e.g., display panel having 1920 horizontal pixels×1080 vertical pixels laid out), the embodiment can surely make the length of the supply-voltage supply path shorter than the comparative example, thus suppressing the voltage drop of the supply voltage and the delay of the application timing thereof In the comparative example, the supply voltage was applied to from one end side of the power source line laid out in the lengthwise direction (row direction) of the display panel to drive each row of display pixels. In the embodiment, however, a pair of power source drivers were arranged facing each other in the short-side direction (column direction) of the display panel, the supply voltage was applied to both ends of the power supply line laid out in the column direction from each power source driver, and the supply voltage was applied to the power source line laid out in the row direction to drive each row of display pixels.

In the embodiment, the power source drivers 140A, 140B are used. Even when only one of the power source drivers 140A, 140B is used, however, the wiring distance becomes shorter than is provided in the case where the one power source driver is arranged on one of the peripheral edge portions 11*d*, 11*e*, thereby bringing about similar advantages.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2006-068992 filed on Mar. 14, 2006 and including specification, claims, drawings and summary. The disclosure of the above Japanese Patent Application is incorporated herein by reference in its entirety.

What is claimed is:

1. A display apparatus having a display panel comprising:

a substrate whose distance between both peripheral edge portions in a column direction is shorter than a distance between both peripheral edge portions in a row direction;

a plurality of display pixels provided on the substrate in the row direction and the column direction;

a plurality of power supply lines provided on the substrate in the column direction;

a plurality of power source lines provided on the substrate in the row direction, wherein each of the plurality of power source lines is connected to at least two of the plurality of power supply lines at nodes, and connected to at least two of the plurality of display pixels provided in the row direction;

an insulation film provided between the plurality of power supply lines and the plurality of power source lines, the insulation film having contact holes, wherein the nodes are positioned in the contact holes;

a first power source drive circuit which applies a first supply voltage to first ends of the plurality of power supply lines; and a second power source drive circuit which applies a second supply voltage which has a same voltage as the first supply voltage to second ends of the plurality of power supply lines concurrently with the application of the first supply voltage;

wherein the first ends and the second ends of the power supply lines are led to both of the peripheral edge portions of the substrate;

wherein a sum of a first distance and a second distance is smaller than half of a length in the row direction of the substrate;

wherein the first distance is a distance between one of the plurality of display pixels and a closest one node electrically connected thereto, the closest one node being closest to the one of the plurality of display pixels in the row direction of the substrate, of all the nodes electrically connected to the one of the plurality of display pixels; and wherein the second distance is a distance between the closest one node and one of first and second ends of a power supply line connected to the closest one node, wherein the power supply line is one of the plurality of power supply lines, and said one of the first and second ends of the power supply line is closer to the closest one node than the other of the first and second ends of the power supply line.

2. The display apparatus according to claim 1, wherein each of the plurality of power supply lines is connected to the plurality of power source lines of an associated one of a plurality of blocks into which the plurality of display pixels are grouped by a predetermined number of rows.

3. The display apparatus according to claim 2, wherein the nodes are provided one for each of a plurality of groups of the plurality of display pixels provided in the row direction by a number of the blocks.

4. The display apparatus according to claim 1, wherein a longest distance of distances from the peripheral edge portions of the substrate in the column direction where the ends of the power supply lines are provided to the nodes is shorter than a longest distance of distances from the peripheral edge portions of the substrate in the row direction to the nodes.

5. The display apparatus according to claim 1, further comprising:

a scan drive circuit which sequentially supplies a scan signal to the plurality of display pixels of each row of the display panel at a predetermined timing to set the plurality of display pixels in a selected state;

a data drive circuit which generates a gradation signal corresponding to display data for displaying desired image information and sequentially supplies the gradation signal to the plurality of display pixels of the row set in the selected state; and a drive control circuit which operates each of the scan drive circuit, the data drive circuit, and the first and second power source drive circuits at a predetermined timing by supplying a timing control signal thereto, thereby allowing the plurality of display pixels of each of a plurality of blocks of the display panel to perform a display operation with a gradation state corresponding to the display data at a time.

6. The display apparatus according to claim 5, wherein during a period in which the data drive circuit sequentially supplies the gradation signal to the plurality of display pixels of each row of each of the blocks, into which the plurality of display pixels are grouped by a predetermined number of rows, the drive control circuit generates the timing control signal which causes the first and second power source drive circuits to apply the first and second supply voltages respectively for allowing the plurality of display pixels of each row of each of the blocks to perform a non-display operation.

7. The display apparatus according to claim 1, wherein the plurality of display pixels include light emitting devices.

8. The display apparatus according to claim 1, wherein the plurality of display pixels include transistors.

9. The display apparatus according to claim 1, wherein the plurality of display pixels include transistors connected to the power source lines.

10. The display apparatus according to claim 1, further comprising:

data lines connected to the plurality of display pixels in the column direction; and scan lines connected to the plurality of display pixels in the row direction.

11. The display apparatus according to claim 1, wherein each of the plurality of display pixels comprises a light emitting device, a drive transistor connected to the light emitting device, and a switch circuit connected to the drive transistor.

12. The display apparatus according to claim 11, wherein the drive transistor is connected to one of the plurality of power source lines.

13. The display apparatus according to claim 11, wherein the switch circuit comprises a first switch transistor connected to the drive transistor and one of the data lines, and a second switch transistor connected to one of the plurality of power source lines.

14. The display apparatus according to claim 1, wherein the first supply voltage of the first power source drive circuit and the second supply voltage of the second power source drive circuit are applied at a low level to one of the plurality of display pixels in a selected state, and are applied at a high level to the one of the plurality of display pixels in an unselected state, wherein the low level is lower than the high level.

15. The display apparatus according to claim 14, wherein each of the plurality of display pixels performing a display operation is in the unselected state.

16. The display apparatus according to claim 14, wherein each of the plurality of display pixels performing a non-display operation is in the selected state.

* * * * *